US009377707B2

(12) United States Patent
Miyakoshi et al.

(10) Patent No.: US 9,377,707 B2
(45) Date of Patent: Jun. 28, 2016

(54) TONER, DEVELOPER, AND IMAGE FORMING APPARATUS

(71) Applicants: Ryo Miyakoshi, Shizuoka (JP); Daisuke Asahina, Shizuoka (JP); Yoshihiro Moriya, Shizuoka (JP); Satoyuki Sekiguchi, Shizuoka (JP); Yuya Hirokawa, Shizuoka (JP)

(72) Inventors: Ryo Miyakoshi, Shizuoka (JP); Daisuke Asahina, Shizuoka (JP); Yoshihiro Moriya, Shizuoka (JP); Satoyuki Sekiguchi, Shizuoka (JP); Yuya Hirokawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/631,136

(22) Filed: Feb. 25, 2015

(65) Prior Publication Data

US 2015/0253686 A1 Sep. 10, 2015

(30) Foreign Application Priority Data

Mar. 10, 2014 (JP) ..... 2014-046182
Sep. 19, 2014 (JP) ..... 2014-190937

(51) Int. Cl.
*G03G 9/08* (2006.01)
*G03G 9/087* (2006.01)

(52) U.S. Cl.
CPC ..... *G03G 9/08755* (2013.01); *G03G 9/08795* (2013.01); *G03G 9/08797* (2013.01)

(58) Field of Classification Search
CPC ..... G03G 9/08755; G03G 9/08797
USPC ..... 430/109.4
See application file for complete search history.

(56) References Cited

FOREIGN PATENT DOCUMENTS

JP 2003-167384 6/2003
JP 2004-309996 11/2004

*Primary Examiner* — Mark A Chapman
(74) *Attorney, Agent, or Firm* — Oblon, McClelland, Maier & Neustadt, L.L.P

(57) ABSTRACT

A toner including a crystalline polyester and an amorphous polyester is provided. When the binder resin is extracted from the toner with tetrahydrofuran to obtain an extracted solution, and the extracted solution is heated to remove the tetrahydrofuran and obtain a deposit, the deposit contains spherical domains of the crystalline polyester having an average particle diameter of 7.0 μm or less.

8 Claims, 4 Drawing Sheets

TONER, DEVELOPER, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-046182 and 2014-190937, filed on Mar. 10, 2014 and Sep. 19, 2014, respectively, in the Japan Patent Office, the entire disclosure of each of which is hereby incorporated by reference herein.

BACKGROUND

1. Technical Field

The present disclosure relates to a toner, a developer, and an image forming apparatus.

2. Description of the Related Art

In a typical electrophotographic image forming apparatus, an electrically- or magnetically-formed latent image is visualized with toner. Specifically, in electrophotography, an electrostatic latent image is formed on a photoconductor and then developed into a toner image with toner. The toner image is transferred onto a transfer medium such as paper and then fixed thereon. In fixing the toner image on a transfer medium, heat fixing methods such as heat roller fixing method and heat belt fixing method are widely employed because of their high energy efficiency.

In recent years, demand for high-speed-printing and energy-saving image forming apparatus is increasing. In accordance with this demand, toner is required to be fixable at much lower temperatures while providing much higher image quality. One approach for achieving low-temperature fixability of toner involves reducing the softening temperature of the binder resin of the toner. However, such a low softening temperature of the binder resin is likely to cause offset phenomenon in which a part of a toner image is adhered to a surface of a fixing member and then retransferred onto a transfer medium in the fixing process. Reducing the softening temperature of the binder resin also reduces heat-resistant storage stability of the toner. As a result, blocking phenomenon in which toner particles fuse together is caused especially in high-temperature environments. In addition, other problems are likely to occur such that toner fuses to contaminate a developing device or carrier particles, or toner forms its film on a surface of a photoconductor.

As a technique for solving these problems, using crystalline resins for the binder resin of toner is known. Crystalline resins have a property of rapidly softening at the melting point. This property makes it possible to lower fixable temperature of toner.

However, merely blending a crystalline resin with an amorphous resin causes a phase separation. Therefore, when a crystalline resin is used for a binder resin of toner, the toner becomes plastic-deformable due to its softness although having high toughness. The technique of merely using a crystalline resin for the binder resin results in a toner having poor heat-resistant storage stability (blocking resistance). Such a toner aggregates in a toner container or image forming apparatus and cannot be supplied for the development of images, resulting in an abnormal image with a low image density.

On the other hand, a crystalline resin can be finely dispersed in toner in a case in which a binder resin containing the crystalline resin and an amorphous resin is emulsified or melt-kneaded under a load from an external force. However, if heat or an external force is applied again, the dispersibility of the crystalline resin gets worse, causing deterioration in low-temperature fixability and blocking resistance.

SUMMARY

In accordance with some embodiments of the present invention, a toner is provided. The toner includes a crystalline polyester and an amorphous polyester. When the binder resin is extracted from the toner with tetrahydrofuran to obtain an extracted solution, and the extracted solution is heated to remove the tetrahydrofuran and obtain a deposit, the deposit contains spherical domains of the crystalline polyester having an average particle diameter of 7.0 μm or less.

In accordance with some embodiments of the present invention, a developer is provided. The developer includes the above toner and a carrier.

In accordance with some embodiments of the present invention, an image forming apparatus is provided. The image forming apparatus includes an electrostatic latent image bearer, an image forming device, and a developing device. The image forming device forms an electrostatic latent image on the electrostatic latent image bearer. The developing device develops the electrostatic latent image into a visible image with the above toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
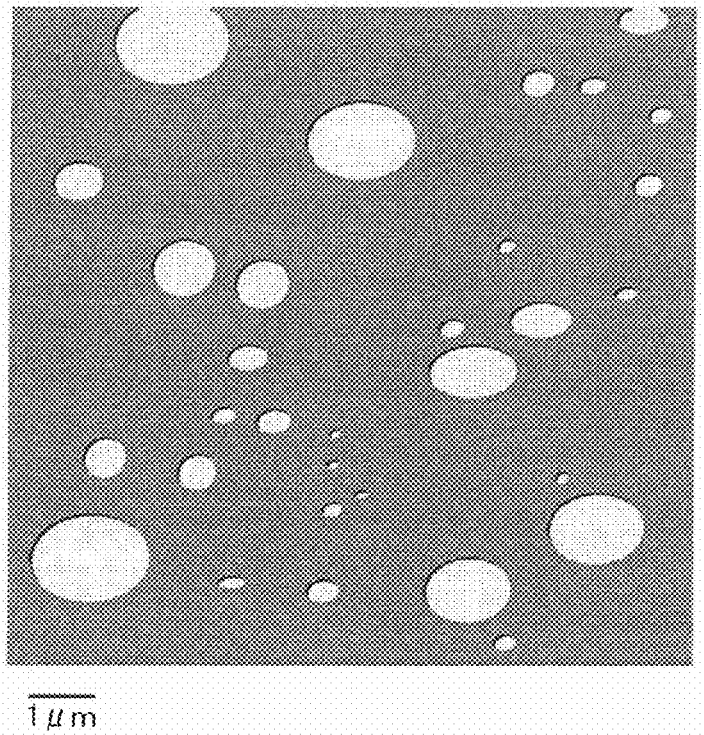
FIG. 1 is a schematic view of crystalline polyester domains in accordance with some embodiments of the present invention.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

One object of the present invention is to provide a toner having a good combination of low-temperature fixability and blocking resistance.

In accordance with some embodiments of the present invention, a toner having a good combination of low-temperature fixability and blocking resistance is provided.

Toner

In accordance with some embodiments of the present invention, the toner includes at least a binder resin and optionally other components, if necessary.

The binder resin includes a crystalline polyester and an amorphous polyester.

When the binder resin is extracted from the toner with tetrahydrofuran to obtain an extracted solution, and the extracted solution is heated to remove the tetrahydrofuran and obtain a deposit, the deposit contains spherical domains of the crystalline polyester. The spherical domains of the crystalline polyester have an average particle diameter of 7.0 μm or less.

The inventors of the present invention have found that merely blending a crystalline resin with an amorphous resin results in formation of crystalline resin domains having a size several tens to several hundred micro-meters. In addition, the inventors have found that merely using a crystalline resin for the binder resin results in poor dispersibility of the crystalline resin, i.e., formation of crystalline resin domains with a large size, which causes deterioration in heat-resistant storage stability (blocking resistance) of the toner.

On the other hand, a crystalline resin can be finely dispersed in toner in a case in which a binder resin containing the crystalline resin and an amorphous resin is emulsified or melt-kneaded under a load from an external force. The inventors have found that, in this case, the crystalline resin is forcibly dispersed finely by means of an external force, and the compatibility of the crystalline resin with the amorphous resin is still low. Therefore, if heat or an external force is applied again, the dispersibility of the crystalline resin will get worse, causing deterioration in low-temperature fixability and blocking resistance.

As a result of keen study in light of the above findings, the inventors of the present invention have found that the low-temperature fixability and blocking resistance of the toner which includes a binder resin including a crystalline polyester and an amorphous polyester depends on the domain size of the crystalline polyester in the deposit of the binder-resin-extracted solution. A specific combination of a crystalline polyester with an amorphous polyester in which the crystalline polyester can be autonomously dispersed finely is advantageous in terms of low-temperature fixability and blocking resistance.

The inventors of the present invention have found that when the specific combination of a crystalline polyester with an amorphous polyester is properly selected in view of the viscosity ratio, content ratio, and difference in surface free energy between the crystalline polyester and the amorphous polyester, the crystalline polyester can be autonomously dispersed finely.

The viscosity ratio and content ratio between the crystalline polyester and the amorphous polyester depend on, at the same temperature and the same composition, the molecular weights of the crystalline polyester and the amorphous polyester and the content of the crystalline polyester. These factors have an influence on the domain size of the crystalline polyester.

As the difference in surface free energy between the crystalline polyester and the amorphous polyester gets smaller, the domain size of the crystalline polyester gets smaller. This is because when the difference in surface free energy between the crystalline polyester and the amorphous polyester gets smaller, the interfacial tension therebetween gets smaller and the compatibility of the crystalline polyester with the amorphous polyester gets improved. Thus, in order to make the domain size of the crystalline polyester smaller, the types of raw material monomers for preparing the crystalline polyester and the amorphous polyester can be selected based on their surface free energy.

The inventors of the present invention have been focusing attention on, in addition to the thermal properties of the amorphous polyester and the crystalline polyester, the molecular weights thereof, the content ratio therebetween, and the difference in surface free energy therebetween so as to reduce the domain size of the crystalline polyester for improving low-temperature fixability and blocking resistance of the toner.

Crystalline Polyester Domains

When the binder resin is extracted from the toner with tetrahydrofuran to obtain an extracted solution, and the extracted solution is heated to remove the tetrahydrofuran and obtain a deposit, the deposit contains spherical domains of the crystalline polyester. The spherical domains of the crystalline polyester have an average particle diameter of 7.0 μm or less. When the average particle diameter exceeds 7.0 μm, it means that the compatibility of the crystalline polyester with the amorphous polyester is poor, causing deterioration in low-temperature fixability or blocking resistance.

Here, the "spherical" domains are not limited to those in the form of a true sphere and also include those in the form of an ellipsoid.

It is preferable that all the crystalline polyester domains in the deposit are spherical.

The spherical domain is observable as a circle or an ellipse in a cross-section of the deposit.

Here, the average particle diameter refers to the arithmetic mean value of the diameters, in the case of true spheres, or the long diameters, in the case of ellipses, among 20 randomly selected spherical domains.

The spherical domain preferably has an aspect ratio of 3 or less, and more preferably 2 or less. When the aspect ratio exceeds 3, it means that the compatibility of the crystalline polyester with the amorphous polyester is too high, causing deterioration in crystallinity of the crystalline polyester and blocking resistance of the toner.

In the toner, the crystalline polyester is forming its domains having an average size of 150 nm or less. When the average size exceeds 150 nm, it means that the compatibility of the crystalline polyester with the amorphous polyester is poor, causing deterioration in low-temperature fixability or blocking resistance.

Here, the average size refers to the arithmetic mean value of the sizes among 20 randomly selected domains.

It is preferable that all the crystalline polyester domains in the toner are also all spherical.

If the crystalline polyester domains, in either the deposition or toner, have needle-like, bar-like, plate-like, or irregular shapes, it means that the phase separation structure is unstable, i.e., the compatibility of the amorphous portions with the crystalline portions is good. Thus, relatively large amounts of the crystalline polymer chains which cannot grow into crystals are remaining at the amorphous portions, making it difficult to maintain sufficient blocking resistance. This tendency is more notable when the domains have irregular shapes.

The deposition is obtained by extracting the binder resin from the toner with tetrahydrofuran to obtain an extracted solution and heating the extracted solution to remove the tetrahydrofuran, as described above. Alternatively, the extracted solution can be replaced with a tetrahydrofuran (THF) solution of a mixture of the amorphous polyester and the crystalline polyester having a mixing ratio equivalent to the content ratio therebetween in the toner.

In the case in which the binder resin is extracted from the toner, 100 parts of the toner are mixed with 100 parts of THF by stirring at room temperature or under heat. Constituents in the extracted solution other than the binder resin, such as a release agent, a charge controlling agent, a colorant, etc., are removed by means of centrifugal separation, filtration, washing, etc. The extracted solution is casted on a support (e.g., TEFLON sheet) and the solvent (i.e., THF) is removed to obtain a deposit in the form of a film. It is preferable that the solvent is removed by means of evaporation, specifically, by means of application of heat, pressure reduction, or ventilation. It is also preferable that the solvent is removed while the extracted solution is standing still and no external force (e.g., compressive force, shearing force) is applied. The domain size of the crystalline polyester can be measured by observing the deposit with a transmission electron microscope (TEM).

Method of Measuring Domain Size of Crystalline Polyester

The toner or deposit is dyed with the vapor of a commercially-available 5% aqueous solution of ruthenium tetraoxide. The dyed toner or deposit is embedded in an epoxy resin and cut into thin sections with a microtome (ULTRACUT-E) equipped with a diamond knife. The thickness of the thin sections is adjusted to approximately 100 nm while observing the interference color of the epoxy resin. The thin sections are put on a copper grid mesh and dyed with the vapor of a commercially-available 5% aqueous solution of ruthenium tetraoxide. The dyed thin sections are observed with a transmission electron microscope (e.g., JEM-2100F from JEOL Ltd.) to obtain cross-sectional images of the toner or deposit. How the crystalline polyester domains are dispersed in the amorphous polyester matrix is evaluated through the observation.

The crystalline polyester is clearly distinguishable in the cross-sectional image as a result of the dyeing treatment of the thin sections. In particular, the crystalline polyester is dyed more weakly than the amorphous polyester. This is because the degree of penetration of the dyeing material into the crystalline polyester is lower than that into the amorphous polyester due to the difference in density therebetween.

The amount of ruthenium atoms existing on the section depends on the degree of dyeing. A strongly-dyed portion does not transmit electron beams due to the existence of a large amount of ruthenium atoms, and such portion is observed as a black portion in the image. By contrast, a weakly-dyed portion easily transmits electron beams, and such portion is observed as a white portion in the image.

An example of the cross-sectional image of the deposit is shown in FIG. 1. In FIG. 1, spherical domains having a diameter of from 0.3 to 3.0 μm are illustrated. In particular, FIG. 1 is a cross-sectional image of the deposit obtained in Example 4 described later.

Thermal Property

When the binder resin is extracted from the toner with tetrahydrofuran to obtain an extracted solution and the extracted solution is heated to remove the tetrahydrofuran and obtain a deposit, the deposit preferably has a thermomechanical analysis compressive deformation ratio (herein after "TMA %") of 3.0% or less at 200 mN under a temperature of 40° C. and a relative humidity of 80%. When TMA % exceeds 3.0%, it means that the toner is easily deformable when being transported during summer or by ship or boat. It also means that even if the static storage stability determined by a penetration test, etc., or the storage stability in dry conditions are good, the dynamic storage stability determined inclusive of accidental error factors is poor. Accordingly, the blocking resistance of the toner may deteriorate. When TMA % exceeds 3.0%, the toner particles will coalesce with each other to degrade transportability, transferability, and image quality, especially when transported or stored in warehouse during summer or affected by the inner temperature of a copier, etc.

Binder Resin

The binder resin includes at least a crystalline polyester and an amorphous polyester, and optionally other components, if necessary.

Crystalline Polyester

The crystalline polyester is not limited to any particular resin but is preferably selected from aliphatic polyesters because they have sharply-melting property and high crystallinity.

An aliphatic polyester is obtainable by a polycondensation reaction of a polyol component with a polycarboxylic acid component such as a polycarboxylic acid, polycarboxylic acid anhydride, polycarboxylic acid ester, and/or derivative thereof. In particular, those having no branched structure are preferable.

Polyol

Specific examples of the polyol component include, but are not limited to, diols and trivalent or more valent alcohols.

Specific examples of the diols include, but are not limited to, saturated aliphatic diols. Specific examples of the saturated aliphatic diols include, but are not limited to, straight-chain saturated aliphatic diols and branched-chain saturated aliphatic diols. Among these diols, straight-chain saturated aliphatic diols are preferable, and those having a carbon number of 2 to 12 are more preferable. Branched-chain saturated aliphatic diols may reduce the crystallinity of the crystalline polyester and further reduce the melting point thereof. Saturated aliphatic diols having a carbon number of more than 12 may be difficult to obtain. Thus, the carbon number is preferably 12 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. These compounds can be used alone or in combination.

Among these diols, ethylene glycol, 1,4-butanediol, 1,6-hexanediol, 1,8-octanediol, 1,10-decanediol, and 1,12-dodecanediol are preferable because the resulting crystalline polyester will have high crystallinity and sharply-melting property.

Specific examples of the trivalent or more valent alcohol include, but are not limited to, glycerin, trimethylolethane, trimethylolpropane, and pentaerythritol. These compounds can be used alone or in combination.

Polycarboxylic Acid

Specific examples of the polycarboxylic acid component include, but are not limited to, divalent carboxylic acids and trivalent or more valent carboxylic acids.

Specific examples of the divalent carboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, and mesaconic acid; and anhydrides and lower alkyl esters (having a carbon number of 1 to 3) thereof. These compounds can be used alone or in combination.

Specific examples of the trivalent or more valent carboxylic acids include, but are not limited to, 1,2,4-benzenetricarboxylic acid, 1,2,5-benzenetricarboxylic acid, 1,2,4-naphthalenetricarboxylic acid, and anhydrides and lower alkyl esters (having a carbon number of 1 to 3) thereof. These compounds can be used alone or in combination.

Specific examples of the polycarboxylic acid component further include dicarboxylic acids having sulfonic groups and dicarboxylic acids having double bonds, other than the above-described saturated aliphatic dicarboxylic acids and aromatic dicarboxylic acids.

Preferably, the crystalline polyester is obtained by a polycondensation of a straight-chain saturated aliphatic dicarboxylic acid having a carbon number of 4 to 12 with a straight-chain saturated aliphatic diol having a carbon number of 2 to 12. In other words, the crystalline polyester preferably has a structural unit derived from a saturated aliphatic dicarboxylic acid having a carbon number of 4 to 12 and another structural unit derived from a saturated aliphatic diol having a carbon number of 2 to 12. Such a crystalline polyester has high crystallinity and sharply-melting property and gives low-temperature fixability to the toner.

The crystalline polyester may be a block copolymer of a crystalline polyester and an amorphous polyester. Production method of the block copolymer is not limited to any particular method. For example, the block copolymer can be produced by the following methods (1) to (3).

(1) A method in which an amorphous polyester having been prepared by a polymerization reaction and a crystalline polyester having been prepared by a polymerization reaction are dissolved or dispersed in a solvent and allowed to react with an elongation agent having 2 or more functional groups reactive with terminal hydroxyl or carboxylic group of polymer chain, such as isocyanate group, epoxy group, and carbodiimide group.

(2) A method in which an amorphous polyester having been prepared by a polymerization reaction and a crystalline polyester having been prepared by a polymerization reaction are melt-kneaded and subjected to an ester exchange reaction under reduced pressures.

(3) A method in which a ring-opening polymerization of an amorphous polyester is initiated from a polymer chain terminal of a crystalline polyester having been prepared by a polymerization reaction while hydroxyl groups in the crystalline polyester act as polymerization initiators.

The weight ratio of the amorphous polyester to the crystalline polyester in the block copolymer is preferably from 20/80 to 90/10.

By using the block copolymer in place of the crystalline polyester, the compatibility of the amorphous portions with the crystalline portions gets improved and the domains are downsized. As a result, the amorphous and crystalline portions work more closely with each other, which advantageously leads to the improvement of handling ability and plasticizing effect at high temperatures of the polymers.

The crystalline polyester preferably has a weight average molecular weight (Mw) of from 3,000 to 35,000, more preferably from 10,000 to 35,000, and most preferably from 10,000 to 30,000, when measured by gel permeation chromatography (GPC). When the weight average molecular weight is less than 3,000, the blocking resistance and the resistance to stress, such as that arising from agitation in developing device, of the toner may worsen. When the weight average molecular weight exceeds 35,000, the viscoelasticity of the toner becomes too high when the toner is melted, resulting in deterioration in low-temperature fixability.

The crystalline polyester preferably has a melting point (Tm) of from 40° C. to 140° C., and more preferably from 60° C. to 120° C. When Tm is less than 40° C., the crystalline polyester is likely to melt at low temperatures, degrading blocking resistance of the toner. When Tm exceeds 140° C., the crystalline polyester melts insufficiently upon application of heat at the fixing, degrading low-temperature fixability of the toner.

The melting point can be determined by measuring an endothermic peak value by differential scanning calorimetry (DSC).

The content of the crystalline polyester in the binder resin is preferably from 1% to 30% by weight, more preferably from 1% to 20% by weight, and most preferably from 5% to 20% by weight based on total weight of the binder resin. When the content is less than 1% by weight, low-temperature fixability of the toner may deteriorate. When the content exceeds 30% by weight, the domain size of the crystalline polyester increases, and thereby blocking resistance of the toner degrades.

The crystallinity, molecular structure, etc., of the crystalline polyester can be analyzed by means of NMR, differential scanning calorimetry (DSC), X-ray diffractometry, GC/MS, LC/MS, infrared absorption spectroscopy (IR), etc.

Amorphous Polyester

The amorphous polyester is obtainable from a polyol component and a polycarboxylic acid component such as a polycarboxylic acid, polycarboxylic acid anhydride, polycarboxylic acid ester. The amorphous polyester preferably includes no branched structure.

Polyol

Specific examples of the polyol component include, but are not limited to, divalent alcohols (i.e., diols) such as alkylene glycols having a carbon number of 2 to 36 (e.g., ethylene glycol, 1,2-propylene glycol, 1,3-propylene glycol, 1,4-butylene glycol, 1,6-hexanediol); alkylene ether glycols having a carbon number of 4 to 36 (e.g., diethylene glycol, triethylene glycol, dipropylene glycol, polyethylene glycol, polypropylene glycol, polytetramethylene ether glycol); alicyclic diols having a carbon number of 6 to 36 (e.g., 1,4-cyclohexanedimethanol, hydrogenated bisphenol A); alkylene oxide having a carbon number of 2 to 4 (e.g., ethylene oxide (EO), propylene oxide (PO), butylene oxide (BO)) 1 to 30 mol adducts of the alicyclic diols; and alkylene oxide having a carbon number of 2 to 4 (e.g., EO, PO, BO) 2 to 30 mol adducts of bisphenols (e.g., bisphenol A, bisphenol F, bisphenol S).

Specific examples of the polyol component further include, but are not limited to, trivalent or more valent alcohols such as trivalent or more valent aliphatic polyols having a carbon number of 3 to 36 (e.g., alkanepolyol and intramolecular or intermolecular dehydration product thereof, such as glycerin, triethylolethane, trimethylolpropane, pentaerythritol, sorbitol, sorbitan, polyglycerin, and dipentaerythritol); sugars and derivatives thereof (e.g., sucrose, methyl glucoside); alkylene oxide having a carbon number of 2 to 4 (e.g., EO, PO, BO) 1 to 30 mol adducts of the aliphatic polyols; alkylene oxide having a carbon number of 2 to 4 (e.g., EO, PO, BO) 2 to 30 mol adducts of trisphenols (e.g., trisphenol PA); and alkylene oxide having a carbon number of 2 to 4 (e.g., EO, PO, BO) 2 to 30 mol adducts of novolac resins (e.g., phenol novolac, cresol novolac) having an average polymerization degree of 3 to 60. These compounds can be used alone or in combination.

Polycarboxylic Acid

Specific examples of the polycarboxylic acid component include, but are not limited to, divalent carboxylic acids (i.e., dicarboxylic acids) such as alkane dicarboxylic acids having a carbon number of 4 to 36 (e.g., succinic acid, adipic acid, sebacic acid) and alkenyl succinic acid (e.g., dodecenyl succinic acid); alicyclic dicarboxylic acids having a carbon number of 4 to 36 (e.g., dimer acids such as dimeric linoleic acid); alkene dicarboxylic acids having a carbon number of 4 to 36 (e.g., maleic acid, fumaric acid, citraconic acid, mesaconic acid); and aromatic dicarboxylic acids having a carbon number of 8 to 36 (e.g., phthalic acid, isophthalic acid, terephthalic acid, derivatives thereof, and naphthalenedicarboxylic acid). Among these compounds, alkene dicarboxylic acids having a carbon number of 4 to 20 and aromatic dicarboxylic acids having a carbon number of 8 to 20 are preferable. Additionally, anhydrides and lower alkyl esters having a carbon number of 1 to 4 (e.g., methyl ester, ethyl ester, isopropyl ester) of the above-described compounds are also usable. These compounds can be used alone or in combination.

In addition, ring-opening polymerization products such as polylactic acid and polycarbonate diol are also preferable.

The amorphous polyester preferably has a weight average molecular weight (Mw) of from 10,000 to 35,000, more preferably from 15,000 to 30,000, when measured by gel permeation chromatography (GPC).

The amorphous polyester preferably has a glass transition temperature (Tg) of from 50° C. to 80° C. When Tg is less than 50° C., the blocking resistance and the resistance to stress, such as that arising from agitation in developing device, of the toner may worsen.

When Tg exceeds 80° C., the viscoelasticity of the toner becomes too high when the toner is melted, resulting in deterioration in low-temperature fixability.

The amorphous polyester preferably has a softening temperature of from 130° C. to 180° C.

The molecular structure of the amorphous polyester can be confirmed by means of solution or solid NMR, GC/MS, LC/MS, IR, etc.

The amorphous polyester may have terminal carboxyl groups for the purpose of improving dispersibility of colorants (e.g., carbon black, pigment) and charge controlling agents, and charge quantity.

The amorphous polyester preferably has an acid value of 20 mgKOH/g or less, and more preferably 18 mgKOH/g or less. When the acid value exceeds 20 mgKOH/g, domain formation may be defective due to the increase of polar groups. In addition, storage stability and charge quantity of the toner may decrease in accordance with environmental fluctuation, particularly humidity fluctuation. Moreover, resin embrittlement may occur.

A proper acid value can be given to the amorphous polyester by using a carboxylic acid having 3 or more valences in preparing the amorphous polyester. Specific examples of the carboxylic acid having 3 or more valences include, but are not limited to, 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, enpol trimmer acid, and anhydrides and partial lower alkyl esters of these compounds.

An acid value can be given to the amorphous polyester by, for example, synthesizing a polyester having terminal hydroxyl groups and adding adequate amount of trimellitic anhydride etc. thereto so as to introduce acid groups to the terminals of the polyester. The amorphous polyester having terminal acid groups can be further modified for the purpose of improving colorant dispersing ability. For example, at the termination of the synthesis or at the preparation of the solution, an alkanolamine serving as a counter ion or a polyethylenimine or polyallylamine can be added so as to form a salt and/or a partial amide-modified structure. Preferably, the polyethylenimine or polyallylamine is a branched type, not a linear type.

Combination of Crystalline Polyester and Amorphous Polyester

The difference in surface free energy between the crystalline polyester and the amorphous polyester is preferably from 6.0 to 15.0 $Jm^{-2}$, and more preferably from 6.0 to 12.5 $Jm^{-2}$. When the difference in surface free energy is less than 6.0 $Jm^{-2}$, spherical domains cannot be obtained. When the difference in surface free energy exceeds 15.0 $Jm^{-2}$, the domain size of the crystalline polyester increases, and thereby blocking resistance of the toner degrades.

The surface free energy of the crystalline polyester and amorphous polyester can be determined by the following formula based on the Extended Fowkes' theory.

$$((1+\cos\theta)\gamma_L)/2=(\gamma_L^d\gamma_S^d)^{1/2}+(\gamma_L^p\gamma_L^p)^{1/2}+(\gamma_L^p\gamma_S^p)^{1/2}$$

In the formula, θ represents a contact angle of a solvent on a thin film of a resin; $\gamma_L$ and $\gamma_S$ respectively represent the surface free energy of the solvent and the resin; and d, p, and h respectively represent a variance component, a polar component, a hydrogen-bond component of the surface free energy, where the equation $\gamma=\gamma^d+\gamma^p+\gamma^h$ is satisfied. The solvent is selected from solvents whose $\gamma^d_L$, $\gamma^p_L$, and $\gamma^h_L$ are already known such as those described in Journal of the Adhesion Society of Japan, Vol. 8, No. 3, 131-141 (1972). Specific examples of such solvents include, but are not limited to, pure water, ethylene glycol, and formaldehyde.

In measuring contact angle, the dropping amount of the solvent and the measuring time (i.e., a time lapse after the solvent is dropped on the thin film before the measurement is performed) have a great influence on the result. Accordingly, the dropping amount of the solvent should be set so as not to influence the result, and the measuring time should be set such that the solvent is less likely to expose to temporal change. For example, when the dropping amount of the solvent is set to 4 μL, the measuring time is set to 5,000 msec, 25,000 msec, and 5.0 msec, when the solvent is pure water, ethylene glycol, and formaldehyde, respectively.

In measuring contact angle, preferably, the thin film has a smooth surface. A smooth film can be obtained by, for example, dissolving the resin in a solvent such as tetrahydrofuran (THF) and chloroform and casting the solution on an aluminum plate.

Other Components

The toner may include other components such as a colorant, a release agent, a charge controlling agent, and a fluidizer.

Colorant

Specific examples of the colorant include, but are not limited to, carbon black, iron black, Sudan Black SM, Fast Yellow G, benzidine yellow, Solvent Yellow (21, 77, 114, etc.), Pigment Yellow (12, 14, 17, 83, etc.), Irgazin® Red, paranitraniline red, tolidine red, Solvent Red (17, 49, 128, 5, 13, 22, 48-2, etc.), Disperse Red, Carmine FB, Pigment Orange R, Lake Red 2G, Rhodamine FB, Rhodamine B Lake, Methyl Violet B Lake, Phthalocyanine Blue, Solvent Blue (25, 94, 60, 15.3, etc.), Pigment Blue, Brilliant Green, Phthalocyanine Green, Oil Yellow GG, KAYASET YG, Orasol® Brown B, and Oil Pink OP. These compounds can be used alone or in combination.

The content of the colorant is preferably from 0.1 to 40 parts by weight, more preferably from 0.5 to 10 parts by weight, based on 100 parts of the binder resin.

Release Agent

Specific examples of the release agent include, but are not limited to, polyolefin wax, natural waxes (e.g., carnauba wax, montan wax, paraffin wax, rice wax), aliphatic alcohols having 30 to 50 carbon atoms (e.g., triacontanol), fatty acids having 30 to 50 carbon atoms (e.g., triacontanoic carboxylic acid), and mixtures thereof.

Specific examples of the polyolefin wax include, but are not limited to, polymers or copolymers of olefins (e.g., ethylene, propylene, 1-butene, isobutylene, 1-hexene, 1-dodecene, 1-octadecene), including those obtained by polymerization or copolymerization and thermally-degraded polyolefins; oxides of the polymers or copolymers of olefins, obtained with oxygen and/or ozone; maleic-acid-modified products of the polymers or copolymers of olefins, modified with maleic acid or a derivative thereof (e.g., maleic anhydride, monomethyl maleate, monobutyl maleate, dimethyl maleate); copolymers of olefins with unsaturated carboxylic acids (e.g., acrylic acid, methacrylic acid, itaconic acid, maleic anhydride) and/or unsaturated carboxylic acid alkyl esters (e.g., acrylic acid alkyl (having 1 to 18 carbon atoms) esters, methacrylic acid alkyl (having 1 to 18 carbon atoms) esters, maleic acid alkyl (having 1 to 18 carbon atoms) esters); poltmethylenes (e.g., Fischer Tropsch wax such as SASOL wax); metals salts of fatty acids (e.g., calcium stearate); and fatty acid esters (e.g., behenyl behenate).

The release agent preferably has a softening temperature of from 50° C. to 170° C.

The content of the release agent is not limited to any particular value and varied in accordance with the intended purpose.

Charge Controlling Agent

Specific examples of the charge controlling agent include, but are not limited to, nigrosine dyes, triphenylmethane dyes having a tertiary amine side chain, quaternary ammonium salts, polyamine resins, imidazole derivatives, polymers having a quaternary ammonium salt group, metal-containing azo dyes, copper phthalocyanine dyes, metals salts of salicylic acid, boron complexes of benzyl acid, polymers having sulfonic acid group, fluorine-containing polymers, polymers having a halogen-substituted aromatic ring, metal complexes of alkyl derivatives of salicylic acid, and cetyltrimethylammonium bromide.

The content of the charge controlling agent is not limited to any particular value and varied in accordance with the intended purpose.

Fluidizer

Specific examples of the fluidizer include, but are not limited to, colloidal silica, alumina powder, titanium oxide powder, calcium carbonate powder, barium titanate, magnesium titanate, calcium titanate, strontium titanate, zinc oxide, quartz sand, clay, mica, sand-lime, diatom earth, chromium oxide, cerium oxide, red iron oxide, antimony trioxide, magnesium oxide, zirconium oxide, barium sulfate, and barium carbonate.

The content of the fluidizer is not limited to any particular value and varied in accordance with the intended purpose.

The content of the binder resin in the toner is preferably from 30% to 97% by weight, more preferably from 40% to 95% by weight, and most preferably from 45% to 92% by weight. The content of the colorant in the toner is preferably from 0.05% to 60% by weight, more preferably from 0.1% to 55% by weight, and most preferably from 0.5% to 50% by weight. The content of the release agent in the toner is preferably from 0% to 30% by weight, more preferably from 0.5% to 20% by weight, and most preferably from 1% to 10% by weight. The content of the charge controlling agent in the toner is preferably from 0% to 20% by weight, more preferably from 0.1% to 10% by weight, and most preferably from 0.5% to 7.5% by weight. The content of the fluidizer in the toner is preferably from 0% to 10% by weight, more preferably from 0% to 5% by weight, and most preferably from 0.1% to 4% by weight.

Toner Production Method

In accordance with some embodiments of the present invention, the toner may be produced by, for example, kneading-pulverization method, suspension polymerization method, emulsion polymerization aggregation method, and injection/spray granulation method.

A typical kneading-pulverization method may include the processes of melt-kneading the binder resin, the colorant, etc., pulverizing the melted mixture into fine particles, and classifying the fine particles by size.

A typical suspension polymerization method may include the processes of stirring a monomer, a polymerization initiator, the colorant, the release agent, etc. in an aqueous phase containing a dispersion stabilizer to form oil droplets, and increasing the temperature of the oil droplets to cause a polymerization reaction therein, thereby producing toner particles.

A typical emulsion polymerization aggregation method may include the processes of emulsifying or dispersing the binder resin in an aqueous phase and removing the solvent therefrom to obtain binder resin particles, and aggregating and thermally fusing the binder resin particles and the colorant and release agent which are dispersed in an aqueous phase, thereby producing toner particles.

A typical injection/spray granulation method may include the processes of spraying a toner composition liquid, in which toner compositions are dissolved or dispersed in an organic solvent, to form liquid droplets, and removing the organic solvent from the liquid droplets, thereby producing toner particles.

Among the above methods, injection/spray granulation method is advantageous because the crystalline polyester domains having a desired size are easily obtainable. Details of the injection/spray granulation method are described below.

Injection/Spray Granulation Method

A method of producing the toner employing the injection/spray granulation method includes at least a liquid droplet discharge process and a liquid droplet solidification process.

Liquid Droplet Discharge Process and Liquid Droplet Discharge Device

The liquid droplet discharge process is a process in which a toner composition liquid is discharged from at least one discharge hole and formed into liquid droplets. The liquid droplet discharge process is performed by a liquid droplet discharge device. In the liquid droplet discharge process, a vibration is applied to the toner composition liquid contained in a liquid column resonance liquid chamber having discharge holes to form a pressure standing wave therein, and the toner composition liquid is discharged from the discharge holes formed within an area corresponding to an antinode of the pressure standing wave and formed into liquid droplets.

The liquid droplet discharge device includes a liquid column resonance liquid chamber having the discharge holes and a vibration generator that applies a vibration to the toner composition liquid contained in the liquid column resonance liquid chamber. The vibration generator applies a vibration to the toner composition liquid contained in the liquid column resonance liquid chamber to form a pressure standing wave therein, and the toner composition liquid is discharged from the discharge holes formed within an area corresponding to an antinode of the pressure standing wave and formed into liquid droplets.

The discharge holes are not limited in arrangement. Preferably, multiple discharge holes are arranged within at least one area corresponding to an antinode of the pressure standing wave. In addition, preferably, multiple discharge holes are arranged in a single liquid column resonance liquid chamber.

The area corresponding to an antinode of the pressure standing wave is an area where the amplitude of the pressure standing wave is large, i.e., the pressure variation is large, enough to discharge liquid droplets. The area corresponding to an antinode of the pressure standing wave is an area extending from a position at a local maximum amplitude (i.e., a node of the velocity standing wave) toward a position at a local minimum amplitude for a distance ±⅓ of the wavelength, preferably ±¼ of the wavelength. Within the area corresponding to an antinode of the pressure standing wave, even in a case in which multiple discharge holes are provided, each of the multiple discharge holes can discharge uniform liquid droplets at a high degree of efficiency without causing discharge hole clogging, which is preferable.

The liquid column resonance liquid chamber is a liquid chamber in which a pressure standing wave can be formed by a vibration applied from the vibration generator according to the principle of liquid column resonance phenomenon to be described later. The liquid column resonance liquid chamber includes: discharge holes formed within an area corresponding to an antinode of the pressure standing wave; a communication opening formed on a longitudinal end of the liquid column resonance liquid chamber, for supplying a toner composition liquid; and a reflective wall surface formed on at least a part of one or both longitudinal end(s) of the liquid column resonance liquid chamber, that is perpendicular to the longitudinal axis. Preferably, in the liquid column resonance liquid chamber, the vibration generator is disposed on one wall surface which is parallel to the longitudinal direction of the liquid column resonance liquid chamber, and the discharge holes are formed on a wall surface which is facing the wall surface having the vibration generator.

The liquid column resonance liquid chamber is not limited in shape and may be in the form of a quadrangular prism (cuboid), cylinder, or truncated cone.

It is preferable that the reflective wall surface is provided on at least a part of both longitudinal ends of the liquid column resonance liquid chamber. Here, the reflective wall surface is defined as a wall surface formed of a hard material which can reflect sonic wave in liquids, such as a metal material (e.g., aluminum, stainless steel) and a silicone material.

Liquid Droplet Solidification Process and Liquid Droplet Solidification Device

The liquid droplet solidification process is a process in which the liquid droplets are solidified. The liquid droplet solidification process is performed by a liquid droplet solidification device. More specifically, in the liquid droplet solidification process or device, the liquid droplets of the toner composition liquid discharged from the liquid droplet discharge device into a gas phase are solidified (dried). The liquid droplet solidification process or device may further include a collection process or device, respectively, for collecting the solidified particles. Details of the liquid droplet solidification process and the liquid droplet solidification device are described below.

Figure 2:
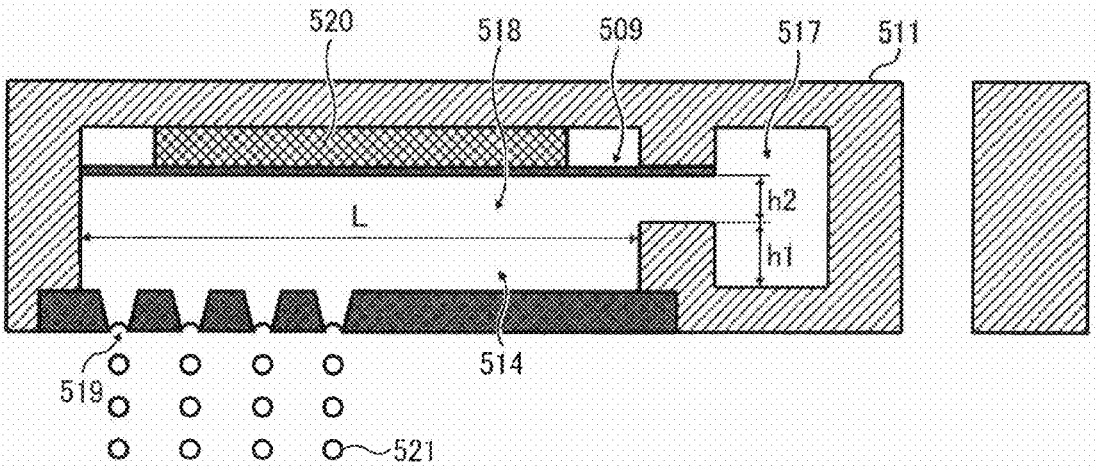
FIG. 2 is a cross-sectional view of a liquid column resonance liquid droplet discharge device in accordance with some embodiments of the present invention.

FIG. 2 is a cross-sectional view of a liquid column resonance liquid droplet discharge device in accordance with some embodiments of the present invention.

The liquid column resonance liquid droplet discharge device 511 has a liquid common supply path 517 and a liquid column resonance liquid chamber 518. The liquid column resonance liquid chamber 518 is communicated with the liquid common supply path 517 disposed on its one end wall surface in a longitudinal direction. The liquid column resonance liquid chamber 518 has discharge holes 519 to discharge liquid droplets 521, on its one wall surface which is connected with its both longitudinal end wall surfaces. The liquid column resonance liquid chamber 518 also has a vibration generator 520 to generate high-frequency vibration for forming a liquid column resonant standing wave, on the wall surface facing the discharge holes 519. The vibration generator 520 is connected to a high-frequency power source.

A toner composition liquid 514, in which toner compositions are dissolved or dispersed, is supplied to the liquid column resonance liquid chamber 518 disposed within the liquid column resonance liquid droplet discharge device 511 through a liquid supply tube by the action of a liquid circulating pump. Within the liquid column resonance liquid chamber 518 filled with the toner composition liquid 514, the vibration generator 520 causes liquid column resonance and generates a pressure standing wave. Thus, a pressure distribution is formed therein. The liquid droplets 521 are discharged from the discharge holes 519 provided within an area corresponding to an antinode of the pressure standing wave, where the amplitude in pressure variation is large. The area corresponding to an antinode is defined as an area not corresponding to a node of the pressure standing wave. Preferably, the area corresponding to an antinode is an area where the amplitude in pressure variation of the standing wave is large enough to discharge liquid droplets. More preferably, the area corresponding to an antinode is an area extending from a position at a local maximum amplitude (i.e., a node of the velocity standing wave) toward a position at a local minimum amplitude for a distance ±¼ of the wavelength of the pressure standing wave. Within the area corresponding to an antinode of the pressure standing wave, even in a case in which multiple discharge holes are provided, each of the multiple discharge holes discharges uniform liquid droplets at a high degree of efficiency without causing discharge hole clogging. After passing the liquid common supply path 517, the toner composition liquid 514 flows into a liquid return pipe and returns to a raw material container. As the liquid droplets 521 are discharged, the amount of the toner composition liquid 514 in the liquid column resonance liquid chamber 518 is reduced, and a suction force generated by the action of the liquid column resonance standing wave is also reduced within the liquid column resonance liquid chamber 518. Thus, the liquid common supply path 517 temporarily increases the flow rate of the toner composition liquid 514 to fill the liquid column resonance liquid chamber 518 with the toner composition liquid 514. After the liquid column resonance liquid chamber 518 is refilled with the toner composition liquid 514, the flow rate of the toner composition liquid 514 in the liquid common supply path 517 is returned.

The liquid column resonance liquid chamber 518 may be formed of joined frames formed of a material having a high stiffness which does not adversely affect liquid resonant frequency of the liquid at drive frequency, such as metals, ceramics, and silicone. A length L between both longitudinal ends of the liquid column resonance liquid chamber 518 illustrated in FIG. 2 is determined based on a mechanism of liquid column resonance to be described in detail later.

The vibration generator 520 is not limited to any particular device so long as it can be driven at a predetermined frequency. For example, the vibration generator 520 may be formed from a piezoelectric body and an elastic plate 509 attached to each other. The elastic plate 509 constitutes a part of the wall of the liquid column resonance liquid chamber 518 so that the piezoelectric body does not contact the liquid. The piezoelectric body may be, for example, a piezoelectric ceramic such as lead zirconate titanate (PZT), which is generally laminated because of having a small displacement. Additionally, piezoelectric polymers such as polyvinylidene fluoride (PVDF), crystals, and single crystals of $LiNbO_3$, $LiTaO_3$, and $KNbO_3$ are also usable. Preferably, the vibration generator 520 in each liquid column resonance liquid chamber 518 is independently controllable. Alternatively, a single blockish vibrating material may be partially cut to fit the arrangement of the liquid column resonance liquid chambers 518 so that each liquid column resonance liquid chamber 518 is independently controllable through the elastic plate.

The opening portion of each discharge holes 519 preferably has a diameter of from 1 to 40 μm. When the diameter is less than 1 μm, the resulting liquid droplets may be too small to be used as a toner. In a case in which the liquid includes solid fine particles of toner constituents, such as pigments, the discharge holes 519 will be clogged frequently and the productivity will decrease. When the diameter is greater than 40 μm, the diameter of each liquid droplet may be too large. In a case in which such large liquid droplets are dried and solidified into toner particles having a desired particle diameter of from 3 to 6 μm, the toner composition needs to be diluted into a very dilute liquid with an organic solvent, which requires a large amount of drying energy in obtaining a predetermined amount of toner.

A mechanism of liquid droplet formation is described in detail below.

First, a mechanism of liquid column resonance generated in the liquid column resonance liquid chamber 518 in the liquid column resonance liquid droplet discharge device 511 is described. The resonant wavelength λ is represented by the following formula (1):

$$\lambda = c/f \tag{1}$$

wherein c represents a sonic speed in the toner composition liquid in the liquid column resonance liquid chamber 518 and f represents a drive frequency given to the toner composition liquid from the vibration generator 520.

Referring to FIG. 2, L represents a length between the fixed end of the frame of the liquid column resonance liquid chamber 518 and the other end thereof closer to the liquid common supply path 517; h1 (e.g., about 80 μm) represents a height of the end of the frame of the liquid column resonance liquid chamber 518 closer to the liquid common supply path 517; and h2 (e.g., about 40 μm) represents a height of a communication opening between the liquid column resonance liquid chamber 518 and the liquid common supply path 517. The height h1 is about twice as much as the height h2. The end closer to the liquid common supply path 517 is equivalent to a fixed end. When both ends are fixed, resonance most effectively occurs when the length L is an even multiple of λ/4. In this case, the length L is represented by the following formula (2):

$$L = (N/4)\lambda \tag{2}$$

wherein N represents an even number.

The formula (2) is also satisfied when both ends of the liquid column resonance liquid chamber 518 are completely open or free.

Similarly, when one end is open or free so that pressure can be released and the other end is closed or fixed, resonance most effectively occurs when the length L is an odd multiple of λ/4. In this case, the length L is represented by the formula (2) as well, wherein N represents an odd number.

Thus, the most effective drive frequency f is derived from the formulae (1) and (2) and represented by the following formula (3):

$$f = N \times c/(4L) \tag{3}$$

wherein L represents the longitudinal length of the liquid column resonance liquid chamber 518, c represents a sonic speed in the toner composition liquid, and N represents a natural number. Actually, vibration is not infinitely amplified because the liquid attenuates resonance due to its viscosity. Therefore, resonance can occur even at a frequency around the most effective drive frequency f represented by the formula (3), as shown in the later-described formula (4) or (5).

Figure 3:
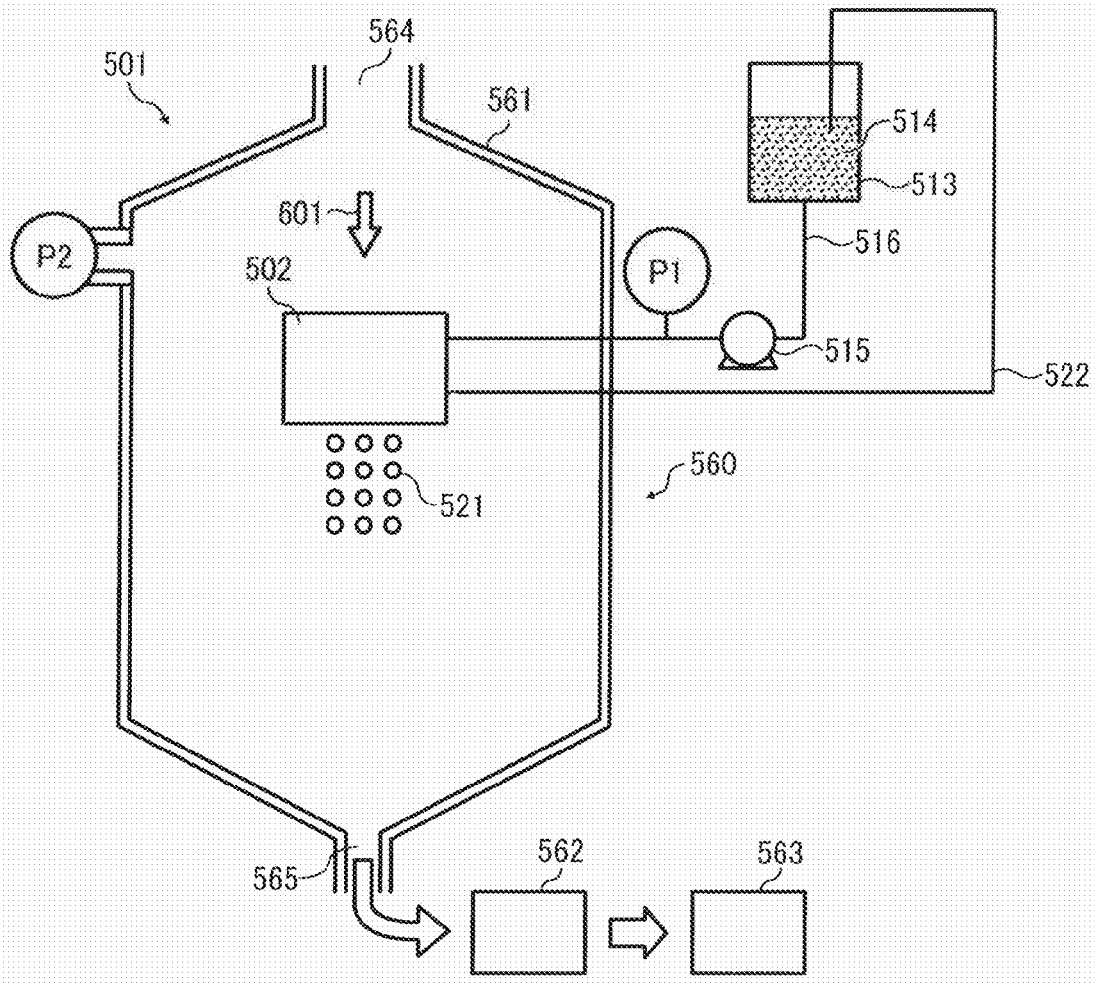
FIG. 3 is a schematic view of an apparatus for manufacturing the toner in accordance with some embodiments of the present invention.

FIG. 3 is a cross-sectional view of an apparatus for manufacturing the toner according to an embodiment of the present invention. A toner manufacturing apparatus 501 has a liquid droplet discharge device 502 and a drying collecting unit 560.

The liquid column resonance liquid droplet discharge device 511 described above can be preferably used for the liquid droplet discharge device 502. The liquid droplet discharge device 502 is connected to a raw material container 513 containing the toner composition liquid 514 through a liquid supply pipe 516 to supply the toner composition liquid 514 from the raw material container 513 to the liquid droplet discharge device 502. The liquid droplet discharge device 502 is further connected to a liquid return pipe 522 to return the toner composition liquid 514 to the raw material container 513, and a liquid circulating pump 515 to pump the toner composition liquid 514 within the liquid supply pipe 516. Thus, the toner composition liquid 514 can be constantly supplied to the liquid droplet discharge device 502. The liquid supply pipe 516 and the drying collecting unit 560 are equipped with pressure gauges P1 and P2, respectively. The pressure gauges P1 and P2 monitor the liquid feed pressure toward the liquid droplet discharge device 502 and the inner pressure of the drying collecting unit 560, respectively. When the pressure measured by the pressure gauge P1 is greater than that measured by the pressure gauge P2, there is a concern that the toner composition liquid 514 leaks from the discharge holes 519. When the pressure measured by the pressure gauge P1 is smaller than that measured by the pressure gauge P2, there is a concern that a gas flows in the liquid droplet discharge device 502 and the liquid droplet discharge phenomenon is stopped. Thus, preferably, the pressure measured by the pressure gauge P1 is nearly identical to that measured by the pressure gauge P2.

The drying collecting unit 560 includes a chamber 561, a toner collector 562, and a toner storage 563.

The liquid droplets 521 are in a liquid state immediately after being discharged from the liquid droplet discharge device 502. As the liquid droplets 521 are conveyed within the chamber 561, the volatile solvent contained in the toner composition liquid 514 is gradually evaporated and drying of the liquid droplets 521 is accelerated. The liquid droplets 21 are finally alternated into solid particles. The solid particles no more coalesce with each other upon contact with each other. The solid particles, i.e., toner particles, are collected in the toner collector 562 and stored in the toner storage 563. The toner particles stored in the toner storage 563 may be further dried in another process, if necessary.

Within the chamber 561, a conveyance airflow 601 is formed through a conveyance airflow inlet 564. The liquid droplets 521 discharged from the liquid droplet discharge device 502 are conveyed downward by the action of gravity as well as the conveyance airflow 601. Thus, the injected liquid droplets 521 are prevented from decelerating by air resistance. Even when liquid droplets 521 are continuously injected, preceding liquid droplets are prevented from decelerating by air resistance and coalescing with subsequent liquid droplets. Accordingly, the liquid droplets 521 are prevented from coalescing with each other and becoming large liquid droplets. In FIG. 3, the liquid droplet discharge device 502 discharges the liquid droplets 521 in the direction of gravitational force, but the direction of discharge is not limited thereto and variable. The conveyance airflow 601 can be generated by applying pressure to the chamber 561 from the conveyance airflow inlet 564 by an air blower or sucking the chamber 561 from a conveyance airflow outlet 565.

The conveyance airflow 601 is not limited in condition so long as the coalescence of the liquid droplets 521 is prevented, and may be, for example, a laminar flow, a swirl flow, or a turbulent flow. The chamber 561 may further include a unit for changing the condition of the conveyance airflow 601.

The conveyance airflow 601 is not limited in substance, and may be formed of, for example, the air or a noncombustible gas such as nitrogen. It is preferable that the conveyance airflow 601 can accelerate drying of the liquid droplets 521 because the liquid droplets 521 become less likely to coalesce with each other as being dried. Accordingly, it is preferable that the conveyance airflow 601 does not include vapors of the solvents contained in the toner composition liquid 514. The temperature of the conveyance airflow 601 is variable but is preferably constant during the manufacturing operation.

The conveyance airflow 601 may prevent not only the coalescence of the liquid droplets 521 but also the adhesion of the liquid droplets 521 to the chamber 561.

Specific examples of the toner collector 562 include, but are not limited to, a cyclone collector and a back filter.

When toner particles collected in the drying collecting unit 560 illustrated in FIG. 3 contain a large amount of residual solvent, the toner particles can be optionally subjected to a secondary drying to reduce the amount residual solvent. If residual solvent is remaining in the toner particles, toner properties such as heat-resistant storage stability, fixability, and chargeability may deteriorate with time. Moreover, when such toner particles are fixed on a recording material by application of heat, the solvent volatilizes with increasing a possibility of adversely affecting users and peripheral devices.

The secondary drying can be performed by any drier, such as a fluidized-bed drier or a vacuum drier.

Kneading-Pulverization Method

The kneading-pulverization method includes the successive process of mixing toner materials, melt-kneading the mixture of the toner materials, pulverizing the kneaded product, classifying the pulverized particles, and adding an external additive to the classified particles. The kneading-pulverization method may further include other processes, if necessary.

Among the particles obtained in the processes of pulverizing and classifying, those deemed inappropriate for the commercial product can be recycled in the process of mixing or melt-kneading.

Process of Mixing Toner Materials

In the process of mixing toner materials, the binder resin, release agent, charge controlling agent, and colorant are mixed by a mixer such as HENSCHEL MIXER.

Process of Melt-Kneading

The resulting mixture is set in a kneader and subjected to the process of melt-kneading.

The kneader may be a single-axis or double-axis continuous kneader or a batch kneader using roll mill.

Specific examples of commercially available kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KOKNEADER from Buss Corporation.

The process of melt-kneading should be performed under the conditions that the molecular chains of the binder resin are not cut.

The melt-kneading temperature should be determined in view of the softening point of the binder resin. When the melt-kneading temperature is too lower than the softening point of the binder resin, the molecular chains are cut significantly. When the melt-kneading temperature is too higher than the softening point of the binder resin, dispersion of the crystalline polyester will not well advance.

In addition, the melt-kneading temperature may be adjusted in view of the melting points of the crystalline polyester and/or the release agent.

Process of Pulverizing

After the process of melt-kneading, the kneaded mixture is pulverized into particles.

Preferably, the kneaded mixture is first pulverized into coarse particles and then into fine particles. Specific examples of the pulverization method include, but are not limited to, a method in which particles are brought into collision with a collision plate in jet stream; a method in which particles are brought into collision with each other; and a method in which particles are put in a narrow gap between mechanically-rotating rotor and stator.

Process of Classifying

The resulting particles are then classified in air stream by means of centrifugal force, etc., to obtain mother toner particles having a desired average particle diameter, for example, from 6 to 10 μm.

Process of Adding External Additive

The mother toner particles are mixed with external additives, such as inorganic fine particles, so that the external additives are fixed or fused on the surfaces of the mother toner particles.

Specific examples of the mixing method include, but are not limited to, a method in which an impulsive force is applied to the mother toner particles by blades rotating at a high speed, and a method in which the mother toner particles are accelerated in a high-speed airflow so that the mother toner particles collide with each other or a collision plate.

Specific examples of the mixer include, but are not limited to, HENSCHEL MIXER (from Mitsui Mining & Smelting Co., Ltd.) and SUPER MIXER (from Kawata Mfg Co., Ltd.).

After the mixing, the mixture is sieved with a mesh having a predetermined opening to remove foreign substances.

Developer

The developer according to some embodiments of the present invention includes at least the above-described toner and optionally other components such as a carrier.

The developer has excellent transferability and chargeability and reliably provides high-quality image. The developer may be either one-component developer or two-component developer. For use in high-speed printers corresponding to recent improvement in information processing speed, two-component developer is preferable because of its extended useful lifespan.

In the one-component developer according to some embodiments of the present invention, the average toner size may not vary very much although consumption and supply of toner particles are repeated. Additionally, the toner particles are prevented from filming a developing roller or adhering to a toner layer regulating blade. Thus, stable developability and image are provided for an extended period of time.

In the two-component developer according to some embodiments of the present invention, the average toner size may not vary very much although consumption and supply of toner particles are repeated. Thus, the two-component developer reliably provides stable developability for an extended period of time.

Carrier

The carrier is not limited in composition. Preferably, the carrier is composed of a core material and a covering layer covering the core material.

Core Material

Specific examples of the core material include, but are not limited to, manganese-strontium materials having a magnetization of from 50 to 90 emu/g and manganese-magnesium materials having a magnetization of from 50 to 90 emu/g. High magnetization materials such as iron powders having a magnetization of 100 emu/g or more and magnetites having a magnetization of from 75 to 120 emu/g are preferable for the purpose of securing image density. Additionally, low magnetization materials such as copper-zinc materials having a magnetization of from 30 to 80 emu/g are preferable for the purpose of improving image quality, because the impact of the developer on the photoconductor can be relaxed.

These compounds can be used alone or in combination.

The core material preferably has a volume average particle diameter of from 10 to 150 μm, more preferably from 40 to 100 μm. When the volume average particle diameter is less than 10 μm, it means that the resulting carrier particles include a relatively large amount of fine particles, and therefore the magnetization per carrier particle is too low to prevent carrier particles from scattering. When the volume average particle diameter is greater than 150 μm, it means that the specific surface area of the carrier particle is too small to prevent toner particles from scattering. Therefore, solid portions in full-color images may not be reliably reproduced.

The toner can be used for a two-component developer by being mixed with the carrier. The content of the carrier is preferably from 90 to 98 parts by weight, more preferably from 93 to 97 parts by weight, based on 100 parts of the two-component developer.

The developer may be used for any electrophotographic method, such as magnetic one-component developing method, non-magnetic one-component developing method, and two-component developing method.

Image Forming Method and Image Forming Apparatus

The image forming apparatus according to some embodiments of the present invention includes at least an electrostatic latent image bearer, an electrostatic latent image forming device, and a developing device, and optionally other devices, if necessary.

The image forming method according to some embodiments of the present invention includes at least an electrostatic latent image forming process and a developing process, and optionally other processes, if necessary.

The image forming method is preferably performed by the image forming apparatus. The electrostatic latent image forming process is preferably performed by the electrostatic latent image forming device. The developing process is preferably performed by the developing device. The other processes are preferably performed by the other devices.

Electrostatic Latent Image Bearer

The electrostatic latent image bearer is not limited in material, structure, and size. Specific examples of usable materials include, but are not limited to, inorganic photoconductors such as amorphous silicon and selenium and organic photoconductors such as polysilane and phthalopolymethine. Among these materials, amorphous silicon is preferable in terms of long operating life.

An amorphous silicon photoconductor can be prepared by, for example, heating a support to from 50° C. to 400° C. and forming a photoconductive layer composed of amorphous silicon on the support by means of vacuum evaporation, sputtering, ion plating, thermal CVD (Chemical Vapor Deposition), optical CVD, or plasma CVD. In particular, plasma CVD, which forms an amorphous silicon film on the support by decomposing a raw material gas by a direct-current, high-frequency, or micro-wave glow discharge, is preferable.

The electrostatic latent image bearer is not limited in shape but preferably in the form of a cylinder. The electrostatic latent image bearer in the form of a cylinder preferably has an outer diameter of from 3 to 100 mm, more preferably from 5 to 50 mm, and most preferably from 10 to 30 mm.

Electrostatic Latent Image Forming Process and Electrostatic Latent Image Forming Device The electrostatic latent image forming device is not limited in configuration so long as it forms an electrostatic latent image on the electrostatic latent image bearer. The electrostatic latent image forming device may include at least a charger to charge a surface of the electrostatic latent image bearer and an irradiator to irradiate the surface of the electrostatic latent image bearer with light containing image information.

The electrostatic latent image forming process is a process in which an electrostatic latent image is formed on the electrostatic latent image bearer. The electrostatic latent image forming process can be performed by, for example, charging a surface of the electrostatic latent image bearer and irradiating the surface with light containing image information. The electrostatic latent image forming process can be performed by the electrostatic latent image forming device.

Charger and Charging Process

Specific examples of the charger include, but are not limited to, a contact charger equipped with a conductive or semi-conductive roller, brush, film, or rubber blade, and a non-contact charger employing corona discharge such as corotron and scorotron.

In the charging process, the charger charges a surface of the electrostatic latent image bearer by applying a voltage thereto.

The shape of the charger is determined in accordance with the specification or configuration of the image forming apparatus, and may be in the form of a roller, a magnetic brush, a fur brush, etc.

The charger is not limited to the contact charger. However, the contact charger is preferable because it can reduce the amount of by-product ozone.

Irradiator and Irradiation Process

The irradiator is not limited in configuration so long as it irradiates the charged surface of the electrostatic latent image bearer with light containing image information.

Specific examples of the irradiator include, but are not limited to, various irradiators of radiation optical system type, rod lens array type, laser optical type, and liquid crystal shutter optical type.

Specific examples of light sources for use in the irradiator include, but are not limited to, luminescent materials such as fluorescent lamp, tungsten lamp, halogen lamp, mercury lamp, sodium lamp, light emitting diode (LED), laser diode (LD), and electroluminescence (EL).

For the purpose of emitting light having a desired wavelength only, any type of filter can be used such as sharp cut filter, band pass filter, near infrared cut filter, dichroic filter, interference filter, and color-temperature conversion filter.

In the irradiation process, the irradiator irradiates the surface of the electrostatic latent image bearer with light containing image information.

It is also possible that the irradiator irradiates the back surface of the electrostatic latent image bearer with light containing image information.

Developing Device and Developing Process

The developing device is not limited in configuration so long as it develops the electrostatic latent image formed on the electrostatic latent image bearer into a visible image with toner.

The developing process is a process in which the electrostatic latent image formed on the electrostatic latent image bearer is developed into a visible image with toner. The developing process can be performed by the developing device.

The developing device may employ either a dry developing method or a wet developing method. The developing device may be either a single-color developing device or a multicolor developing device.

The developing device preferably includes a stirrer for stirring the toner to frictionally charge the toner and a developer bearer for bearing a developer containing the toner. The developer bearer is rotatable and has an internally-fixed magnetic field generator. In the developing device, the toner and carrier particles are mixed and stirred and the toner particles are charged by friction. The charged toner particles are retained on the surface of a rotating magnet roller in the form of ears, forming magnetic brush. The magnet roller is disposed adjacent to the electrostatic latent image bearer. Therefore, part of the toner particles composing the magnetic brush formed on the surface of the magnet roller are moved to the surface of the electrostatic latent image bearer by an electric attractive force. As a result, the electrostatic latent image is developed with the toner particles to form a visible image on the surface of the electrostatic latent image bearer.

Other Devices and Other Processes

The other devices may include, for example, a transfer device, a fixing device, a cleaner, a neutralizer, a recycler, and a controller.

The other processes may include, for example, a transfer process, a fixing process, a cleaning process, a neutralization process, a recycle process, and a control process.

Transfer Device and Transfer Process

The transfer device is not limited in configuration long as it transfers the visible image onto a recording medium. The transfer device preferably includes a primary transfer device to transfer the visible image onto an intermediate transfer medium to form a composite image and a secondary transfer device to transfer the composite image onto a recording medium.

The transfer process is a process in which the visible image is transferred onto a recording medium. It is preferable that the visible image is primarily transferred onto an intermediate transfer medium and then secondarily transferred onto the recording medium.

In the transfer process, the visible image is transferred by charging the electrostatic latent image bearer (photoconductor) by a transfer charger. The transfer process can be performed by the transfer device.

In a case in which the image to be secondarily transferred onto the recording medium is a color image composed of multiple color toners, the transfer device sequentially superimpose the multiple color toners one another on the intermediate transfer medium, and then the resulting composite image is transferred from the intermediate transfer medium onto the recording medium at once.

Specific examples of the intermediate transfer medium include, but are not limited to, transfer belt.

The transfer device preferably includes a transferrer to separate the visible image formed on the electrostatic latent image bearer (photoconductor) to the recording medium side by charging. Specific examples of the transferrer include, but are not limited to, corona transferrer, transfer belt, transfer roller, pressure transfer roller, and adhesive transferrer.

The recording medium is not limited in material and may be normal paper, PET films for use in overhead projector (OHP), etc.

Fixing Device and Fixing Process

The fixing device is not limited in configuration so long as it fixes the transferred image on the recoding medium. The fixing device preferably includes a heat-pressure member. Specific examples of the heat-pressure member include, but are not limited to, a combination of a heat roller and a pressure roller; and a combination of a heat roller, a pressure roller, and an endless belt.

The fixing process is a process in which the visible image transferred onto the recording medium is fixed thereon. The fixing process may be performed either every time each color toner is transferred onto the recording medium or at once after all color toners are superimposed on one another.

The fixing process can be performed by the fixing device.

The heating temperature is normally from 80° C. to 200° C.

The fixing device may be used together with or replaced with an optical fixer.

In the fixing process, the fixing pressure is preferably from 10 to 80 $N/cm^2$.

Cleaner and Cleaning Process

The cleaner is not limited in configuration so long as it removes residual toner particles remaining on the electrostatic latent image bearer. Specific examples of the cleaner include, but are not limited to, magnetic brush cleaner, electrostatic brush cleaner, magnetic roller cleaner, blade cleaner, brush cleaner, and web cleaner.

The cleaning process is a process in which residual toner particles remaining on the electrostatic latent image bearer are removed. The cleaning process can be performed by the cleaner.

Neutralizer and Neutralization Process

The neutralizer is not limited in configuration so long as it neutralizes the electrostatic latent image bearer by applying a neutralization bias thereto. Specific examples of the neutralizer include, but are not limited to, neutralization lamp.

The neutralization process is a process in which the electrostatic latent image bearer is neutralized by being applied with a neutralization bias. The neutralization process can be performed by the neutralizer.

Recycler and Recycle Process

The recycler is not limited in configuration so long as it makes the developing device recycle the toner removed in the cleaning process. Specific examples of the recycler include, but are not limited to, conveyer.

The recycle process is a process in which the toner particles removed in the cleaning process are recycled by the developing device. The recycle process can be performed by the recycler.

Controller and Control Process

The controller is not limited in configuration so long as it controls the above-described processes. Specific examples of the controller include, but are not limited to, sequencer and computer.

The control process is a process in which the above-descried processes are controlled. The control process can be performed by the controller.

Figure 4:
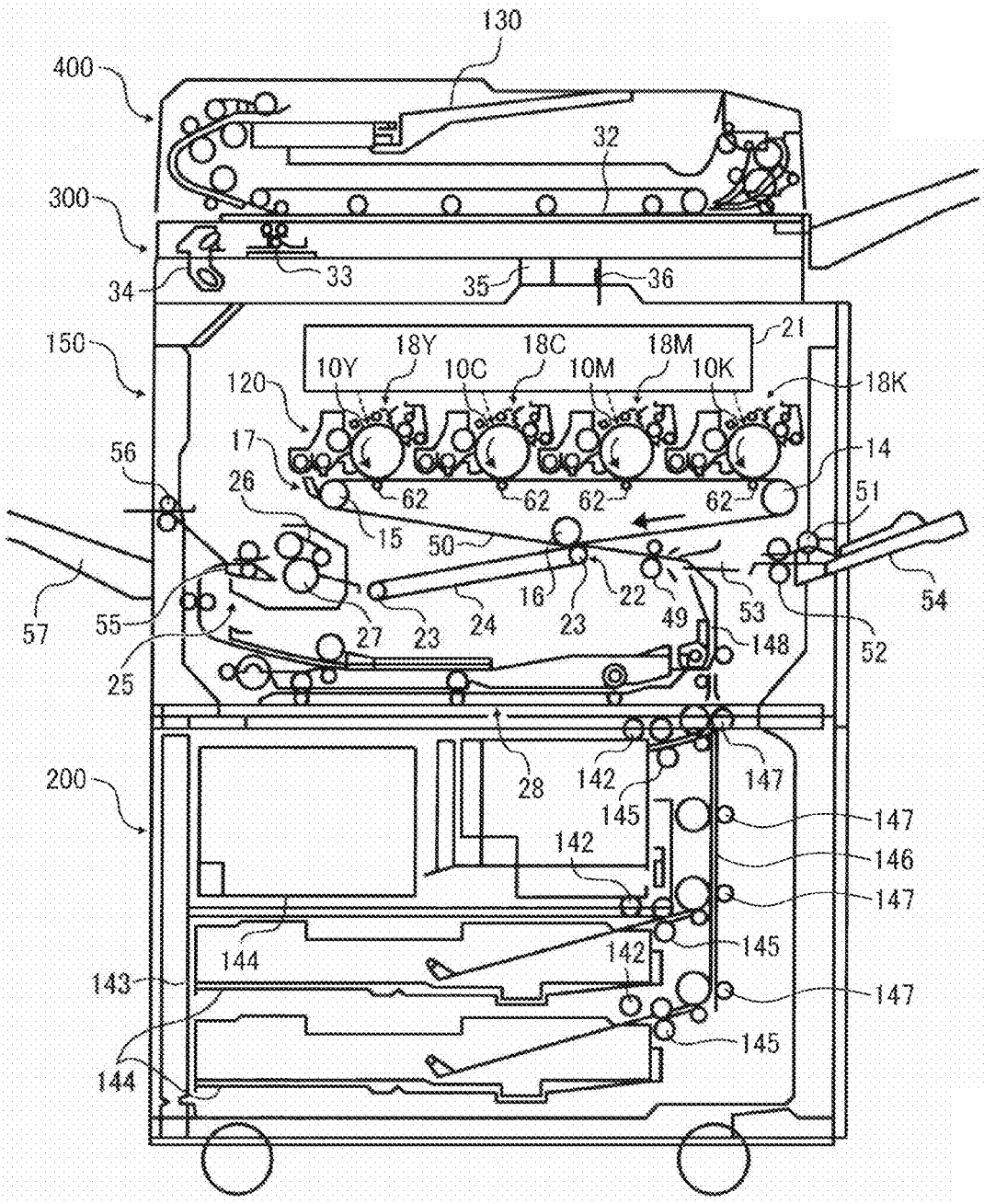
FIG. 4 is a schematic view of an image forming apparatus in accordance with some embodiments of the present invention.

FIG. 4 is a schematic view of an image forming apparatus according to some embodiments of the present invention. An image forming apparatus illustrated in FIG. 4 includes a main body 150, a paper feeding table 200, a scanner 300, and an automatic document feeder (ADF) 400.

An intermediate transfer medium 50 in the form of an endless belt is disposed at the center of the main body 150. The intermediate transfer medium 50 is stretched taut with three support rollers 14, 15, and 16 and is rotatable clockwise in FIG. 4. A cleaner 17 for removing residual toner particles remaining on the intermediate transfer medium 50 is disposed adjacent to the support roller 15. Image forming units 18Y, 18C, 18M, and 18K to produce respective images of yellow, cyan, magenta, and black are arranged in tandem along a surface of the intermediate transfer medium 50 stretched between the support rollers 14 and 15, constituting a tandem image forming part 120. An irradiator 21 is disposed adjacent to the tandem image forming part 120. A secondary transfer device 22 is disposed on the opposite side of the tandem image forming part 120 relative to the intermediate transfer medium 50. In the secondary transfer device 22, a secondary transfer belt 24 in the form of an endless belt is stretched taut with a pair of rollers 23. A sheet of transfer paper conveyed on the secondary transfer belt 24 is contactable with the intermediate transfer medium 50. A fixing device 25 is disposed adjacent to the secondary transfer device 22. The fixing device 25 includes a fixing belt 26 in the form of an endless belt and a pressing roller 27 pressed against the fixing belt 26.

A sheet reversing device 28 is disposed adjacent to the secondary transfer device 22 and the fixing device 25 to reverse a sheet of transfer paper upside down, so that images can be formed on both sides of the sheet.

In the tandem image forming part 120, a full-color image is produced in the manner described below. A document is set on a document table 130 of the automatic document feeder 400 or on a contact glass 32 of the scanner 300 while the automatic document feeder 400 is lifted up, followed by holding down of the automatic document feeder 400.

As a switch is pressed, in a case in which a document is set on the contact glass 32, the scanner 300 immediately starts driving. In a case in which a document is set on the automatic document feeder 400, the scanner 300 starts driving after the document is fed onto the contact glass 32. A first runner 33 and a second runner 34 then start running. The first runner 33 directs light from a light source to the document, and reflects light reflected from the document toward the second runner 24. A mirror in the second runner 34 reflects the light toward a reading sensor 36 through an imaging lens 35. Thus, the document is read and converted into image information of yellow, cyan, magenta, and black.

Figure 5:
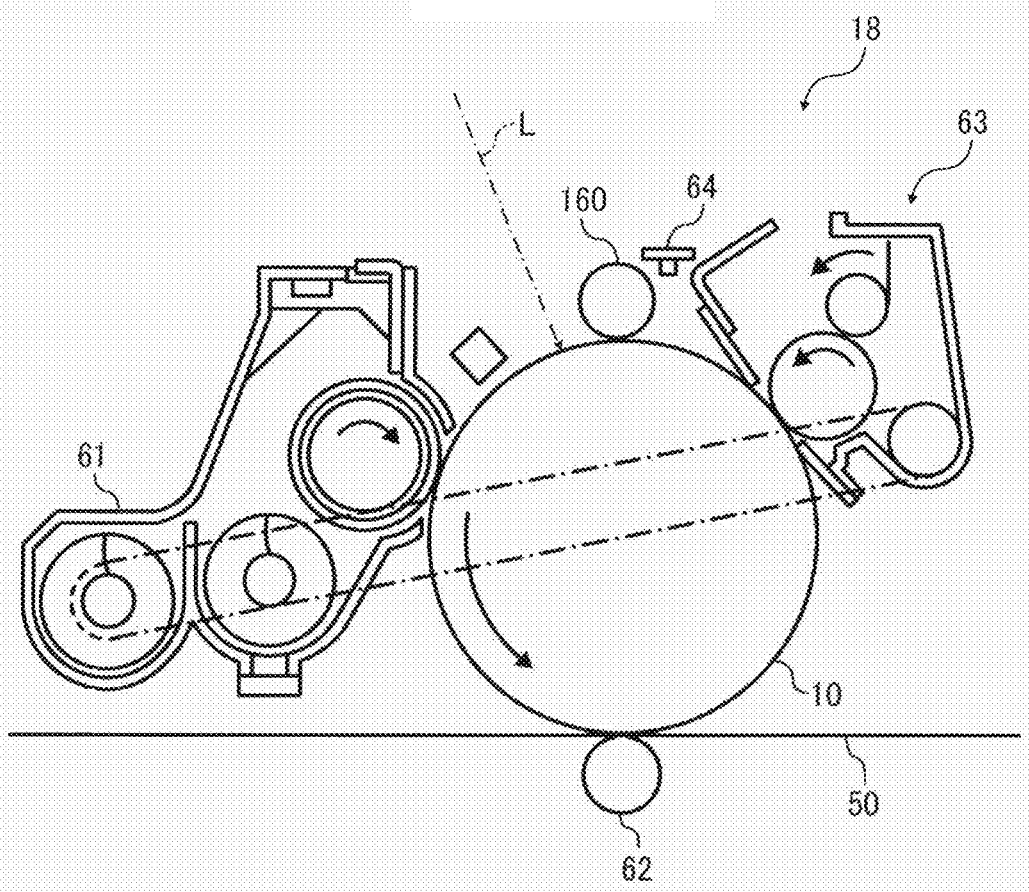
FIG. 5 is a partial magnified view of FIG. 4.

The image information of yellow, cyan, magenta, and black are respectively transmitted to the image forming units 18Y, 18C, 18M, and 18K. The image forming units 18Y, 18C, 18M, and 18K form respective toner images of yellow, cyan, magenta, and black. As illustrated in FIG. 5, each of the image forming units 18 includes an electrostatic latent image bearer 10, a charger 160 to uniformly charge the electrostatic latent image bearer 10, an irradiator to irradiate the charged surface of the electrostatic latent image bearer 10 with light L containing image information to form an electrostatic latent image thereon, a developing device 61 to develop the electrostatic latent image into a toner image with each color toner, a transfer charger 62 to transfer the toner image onto the intermediate transfer medium 50, a cleaner 63, and a neutralizer 64. The image forming units 18Y, 18C, 18M, and 18K respectively form single-color toner images of yellow, cyan, magenta, and black. The toner images of yellow, cyan, magenta, and black are primarily transferred sequentially from the respective electrostatic latent image bearers 10Y, 10C, 10M, and 10K onto the intermediate transfer medium 50 that is rotatably moved by the support rollers 14, 15, and 16. Thus, the toner images of yellow, cyan, magenta, and black are superimposed on one another on the intermediate transfer medium 50, forming a composite full-color toner image.

On the other hand, as the switch is pressed, one of paper feed rollers 142 starts rotating in the paper feeding table 200 to feed sheets of recording paper from one of paper feed cassettes 144 in a paper bank 143. One of separation rollers 145 separates the sheets one by one and feeds them to a paper feed path 146. Feed rollers 147 feed each sheet to a paper feed path 148 in the main body 150. The sheet is stopped upon striking a registration roller 49. Alternatively, a feed roller 51 starts rotating to feed sheets from a manual feed tray 54. A separation roller 52 separates the sheets one by one and feeds them to a manual paper feed path 53. The sheet is stopped upon striking the registration roller 49. The registration roller 49 is generally grounded. Alternatively, it is possible that the registration roller 49 is applied with a bias for the purpose of removing paper powders from the recording paper. The registration roller 49 starts rotating to feed the sheet to between the intermediate transfer medium 50 and the secondary transfer device 22 in synchronization with an entry of the composite full-color toner image formed on the intermediate transfer medium 50 thereto so that the composite full-color toner image can be secondarily transferred onto the sheet of recording paper. Thus, the composite full-color toner image is formed on the sheet of recording paper. Residual toner particles remaining on the intermediate transfer medium 50 are removed by the cleaner 17.

The sheet having the composite full-color toner image thereon is fed from the secondary transfer device 22 to the fixing device 25. The fixing device 25 fixes the composite full-color toner image on the sheet by application of heat and pressure. The switch claw 55 switches paper feed paths so that the sheet is ejected by an ejection roller 56 onto an ejection tray 57. Alternatively, the switch claw 55 may switch paper feed paths so that the sheet is introduced into the sheet reversing device 28. In the sheet reversing device 28, the sheet gets reversed to record another image on the back side of the sheet. Thereafter, the sheet is ejected by the ejection roller 56 onto the ejection tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Methods of measuring various properties are described below.

Molecular Weight

Instrument: GPC (from Tosoh Corporation)

Detector: RI

Measuring temperature: 40° C.

Mobile phase: Tetrahydrofuran

Flow rate: 0.45 mL/min

Number average molecular weight (Mn), weight average molecular weight (Mw), and molecular weight distribution (Mw/Mn) are determined by GPC (gel permeation chromatography) with reference to a calibration curve complied from polystyrene standard samples whose molecular weights are already known. Tandemly-connected columns having exclusion limits of 60,000, 20,000, and 10,000 are used.

Softening Temperature

A measurement sample in an amount of 1 g is charged in a Flowtester Capillary Rheometer CFT-500D (from Shimadzu Corporation). After preheated at 50° C., the sample is heated at a heating rate of 5° C./min while a load of 30 kg is applied to the plunger. The sample is extruded from a nozzle having a diameter of 0.5 mm and a height of 1 mm. A graph showing a relation between the amount of descent (flow) of the plunger and the temperature is drawn. A temperature at which the amount of descent of the plunger becomes ½ the maximum value (i.e., a half of the measurement sample has flowed out) is read from the graph and identified as a softening temperature.

Glass Transition Temperature (Tg) and Melting Point (Tm)

A measurement sample in an amount of 5 mg is charged in a simple sealed pan Tzero (from TA Instruments) and subjected to a measurement with a differential scanning calorimeter (Q2000 from TA Instruments). The measurement is performed under nitrogen gas flow. In the measurement, the sample is heated from 40° C. to 150° C. at a heating rate of 10° C./min to observe thermal change. A graph showing a relation between the amount of heat generation or absorption and the temperature is drawn. A characteristic inflection observable in the graph is identified as a glass transition temperature (Tg). Tg is determined from a DSC curve by the midpoint method. A temperature at which the maximum heat absorption peak is observed is identified as a melting point (Tm).

Domain Size

A mixture of an amorphous polyester and a crystalline polyester at an arbitrary mixing ratio is weighed. Hundred parts of the mixture is dissolved in 100 parts of tetrahydrofuran (THF) at 50° C. The resulting solution is casted on a TEFLON sheet and statically dried under reduced pressures at 60° for 5 hours and subsequently at 120° C. until the THF is removed. The resulting film-like deposit is stored at 40° C. for 24 hours. A cross-section of the deposit is observed with a transmission electron microscope. Twenty randomly-selected domains of the crystalline polyester are subjected to a measurement of the domain size and the average particle diameter is determined.

The domain size of the crystalline polyester in the toner is measured from a cross-section of the toner.

Thermomechanical Analysis Compressive Deformation Ratio (TMA %)

A mixture of an amorphous polyester and a crystalline polyester at an arbitrary mixing ratio is weighed. Hundred parts of the mixture is dissolved in 100 parts of tetrahydrofuran (THF) at 50° C. The resulting solution is casted on a TEFLON sheet and statically dried under reduced pressures at 60° for 5 hours and subsequently at 120° C. until the THF is removed. The resulting deposit is pulverized and formed into a tablet having a diameter of 10 mm by a pelletizer (from Shimadzu Corporation). The tablet is subjected to a measurement by a thermomechanical analyzer EXSTAR 7000 (from SII Nano Technology Inc.). The measurement is performed by compressing the tablet with a compressive force of 20 mN/min at a temperature of 40° C. and a relative humidity of 80%. A graph showing a relation between the time and the compressive displacement (deformation ratio) is drawn. A compressive displacement (deformation ratio) corresponding to a compressive force of 200 mN is read from the graph and identified as a thermomechanical analysis compressive deformation ratio (TMA %).

Synthesis Example 1

Synthesis of Amorphous Polyester A1

A 5-liter four-neck flask equipped with a nitrogen inlet pipe, a dewatering pipe, a stirrer, and a thermocouple is charged with propylene glycol (serving as a diol) and a mixture of terephthalic acid and adipic acid (serving as dicarboxylic acids) at a molar ratio (terephthalic acid/adipic acid) of 85/15 in amounts such that the molar ratio of OH groups to COOH groups becomes 2.0. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, an amorphous polyester A1 is prepared.

The amorphous polyester A1 has an acid value (AV) of 0.9 mgKOH/g, a hydroxyl value (OHV) of 12.8 mgKOH/g, a glass transition temperature (Tg) of 62.5° C., a softening temperature of 148.3° C., and a weight average molecular weight (Mw) of 22,000.

Synthesis Example 2

Synthesis of Amorphous Polyester A2

The procedure in Synthesis Example 1 is repeated except that the reaction time under reduced pressures at 230° C. is changed to 1 hour. Thus, an amorphous polyester A2 is prepared.

The amorphous polyester A2 has an acid value (AV) of 0.4 mgKOH/g, a hydroxyl value (OHV) of 21.0 mgKOH/g, a glass transition temperature (Tg) of 60.2° C., a softening temperature of 134.5° C., and a weight average molecular weight (Mw) of 18,000.

Synthesis Example 3

Synthesis of Amorphous Polyester A3

The procedure in Synthesis Example 1 is repeated except that the dicarboxylic acids are changed to a mixture of terephthalic acid and succinic acid at a molar ratio (terephthalic acid/succinic acid) of 80/20. Thus, an amorphous polyester A3 is prepared.

The amorphous polyester A3 has an acid value (AV) of 0.9 mgKOH/g, a hydroxyl value (OHV) of 15.2 mgKOH/g, a glass transition temperature (Tg) of 58.6° C., a softening temperature of 139.3° C., and a weight average molecular weight (Mw) of 17,900.

Synthesis Example 4

Synthesis of Amorphous Polyester A4

The procedure in Synthesis Example 1 is repeated except that the dicarboxylic acids are changed to terephthalic acid. Thus, an amorphous polyester A4 is prepared.

The amorphous polyester A4 has an acid value (AV) of 0.8 mgKOH/g, a hydroxyl value (OHV) of 12.5 mgKOH/g, a glass transition temperature (Tg) of 90.0° C., a softening temperature of 190.0° C., and a weight average molecular weight (Mw) of 20,000.

Synthesis Example 5

Synthesis of Amorphous Polyester A5

The procedure in Synthesis Example 1 is repeated except that the diol is changed to a mixture of propylene glycol and bisphenol A ethylene oxide 2 mol adduct at a molar ratio (propylene glycol/bisphenol A ethylene oxide 2 mol adduct) of 75/25, and the dicarboxylic acids are changed to a mixture of terephthalic acid and adipic acid at a molar ratio (terephthalic acid/adipic acid) of 80/20. Thus, an amorphous polyester A5 is prepared.

The amorphous polyester A5 has an acid value (AV) of 0.6 mgKOH/g, a hydroxyl value (OHV) of 10.9 mgKOH/g, a glass transition temperature (Tg) of 58.2° C., a softening temperature of 143.4° C., and a weight average molecular weight (Mw) of 23,700.

Synthesis Example 6

Synthesis of Amorphous Polyester A6

The procedure in Synthesis Example 1 is repeated except that the dicarboxylic acids are changed to a mixture of terephthalic acid and adipic acid at a molar ratio (terephthalic acid/adipic acid) of 80/20. Thus, an amorphous polyester A6 is prepared.

The amorphous polyester A6 has an acid value (AV) of 0.9 mgKOH/g, a hydroxyl value (OHV) of 17.2 mgKOH/g, a glass transition temperature (Tg) of 48.4° C., a softening temperature of 123.2° C., and a weight average molecular weight (Mw) of 16,700.

Synthesis Example 7

Synthesis of Amorphous Polyester A7

The procedure in Synthesis Example 1 is repeated except that the reaction time under reduced pressures at 230° C. is changed to 5 minutes. Thus, an amorphous polyester A7 is prepared.

The amorphous polyester A7 has an acid value (AV) of 0.19 mgKOH/g, a hydroxyl value (OHV) of 77.5 mgKOH/g, a glass transition temperature (Tg) of 31.5° C., a softening temperature of 85.6° C., and a weight average molecular weight (Mw) of 4,000.

Synthesis Example 8

Synthesis of Amorphous Polyester A8

A 5-liter four-neck flask equipped with a nitrogen inlet pipe, a dewatering pipe, a stirrer, and a thermocouple is charged with a mixture of neopentyl glycol and ethylene glycol (serving as diols) at a molar ratio (neopentyl glycol/ethylene glycol) of 50/50 and a mixture of terephthalic acid, isophthalic acid, and adipic acid (serving as polycarboxylic acids) at a molar ratio (terephthalic acid/isophthalic acid/adipic acid) of 40/55/5 in amounts such that the molar ratio of OH groups to COOH groups becomes 1.2. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. After adding 2.5% of trimellitic acid based on the total amount of the polycarboxylic acids, the mixture is subjected to a reaction under normal pressure at 180° C. for 2 hours, subsequently at 8 kPa. Thus, an amorphous polyester A8 is prepared.

The amorphous polyester A8 has an acid value (AV) of 10 mgKOH/g, a hydroxyl value (OHV) of 18.5 mgKOH/g, a glass transition temperature (Tg) of 58.7° C., a softening temperature of 145.3° C., and a weight average molecular weight (Mw) of 31,300.

Synthesis Example 9

Synthesis of Amorphous Polyester A9

A 5-liter four-neck flask equipped with a nitrogen inlet pipe, a dewatering pipe, a stirrer, and a thermocouple is charged with propylene glycol (serving as a diol) and a mixture of terephthalic acid and succinic acid (serving as dicarboxylic acids) at a molar ratio (terephthalic acid/succinic acid) of 90/10 in amounts such that the molar ratio of OH groups to COOH groups becomes 2.0. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 1 hour under reduced pressures of from 10 to 30 mmHg. Thus, an amorphous polyester A9 is prepared.

The amorphous polyester A9 has an acid value (AV) of 0.2 mgKOH/g, a hydroxyl value (OHV) of 22.2 mgKOH/g, a glass transition temperature (Tg) of 71.0° C., a softening temperature of 135.8° C., and a weight average molecular weight (Mw) of 12,800.

Synthesis Example 10

Synthesis of Amorphous Polyester A10

A 5-liter four-neck flask equipped with a nitrogen inlet pipe, a dewatering pipe, a stirrer, and a thermocouple is charged with propylene glycol (serving as a diol) and a mixture of terephthalic acid and succinic acid (serving as dicarboxylic acids) at a molar ratio (terephthalic acid/succinic acid) of 85/15 in amounts such that the molar ratio of OH groups to COOH groups becomes 2.0. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, an amorphous polyester A10 is prepared.

The amorphous polyester A10 has an acid value (AV) of 1.48 mgKOH/g, a hydroxyl value (OHV) of 10.5 mgKOH/g, a glass transition temperature (Tg) of 69.2° C., a softening temperature of 152.1° C., and a weight average molecular weight (Mw) of 19,700.

Synthesis Example 11

Synthesis of Amorphous Polyester A11 A 5-liter four-neck flask equipped with a nitrogen inlet pipe, a dewatering pipe, a stirrer, and a thermocouple is charged with propylene glycol (serving as a diol) and terephthalic acid (serving as a dicarboxylic acid) in amounts such that the molar ratio of OH groups to COOH groups becomes 2.0. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, an amorphous polyester A11 is prepared.

The amorphous polyester A11 has an acid value (AV) of 0.38 mgKOH/g, a hydroxyl value (OHV) of 35.6 mgKOH/g, a glass transition temperature (Tg) of 77.9° C., a softening temperature of 140.4° C., and a weight average molecular weight (Mw) of 9,000.

Synthesis Example 12

Synthesis of Amorphous Polyester A12

A 5-liter four-neck flask equipped with a nitrogen inlet pipe, a dewatering pipe, a stirrer, and a thermocouple is charged with propylene glycol (serving as a diol) and a mixture of terephthalic acid and succinic acid (serving as dicarboxylic acids) at a molar ratio (terephthalic acid/succinic acid) of 90/10 in amounts such that the molar ratio of OH groups to COOH groups becomes 2.0. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, an amorphous polyester A12 is prepared.

The amorphous polyester A12 has an acid value (AV) of 1.02 mgKOH/g, a hydroxyl value (OHV) of 14.8 mgKOH/g, a glass transition temperature (Tg) of 77.3° C., a softening temperature of 166.9° C., and a weight average molecular weight (Mw) of 22,700.

Synthesis Example 13

Synthesis of Amorphous Polyester A13

The procedure in Synthesis Example 10 is repeated. After the termination of the reaction under reduced pressures, the reaction system is cooled to 175° C. under nitrogen gas flow. After adding an appropriate amount of trimellitic acid so that the resulting polymer has an acid value of 6.0 mgKOH/g, the mixture is subjected to a reaction for 1 hour. Thus, an amorphous polyester A13 is prepared.

The addition amount of trimellitic acid is determined from the following equation while setting the target acid value to 6.0 mgKOH/g.

$$\text{Addition amount of trimellitic acid} = A/B$$

$$A = (\text{Weight of resin before acid adjustment}) \times ((\text{Target acid value}) - (\text{Acid vale before acid adjustment}))$$

$$B = (\text{Acid value of trimellitic acid}) - (\text{Target acid value})$$

The amorphous polyester A13 has an acid value (AV) of 6.28 mgKOH/g, a glass transition temperature (Tg) of 69.6° C., a softening temperature of 151.2° C., and a weight average molecular weight (Mw) of 19,200.

Synthesis Example 14

Synthesis of Amorphous Polyester A14

The procedure in Synthesis Example 13 is repeated except that the target acid value is changed to 17 mgKOH/g. Thus, an amorphous polyester A14 is prepared.

The amorphous polyester A14 has an acid value (AV) of 17.2 mgKOH/g, a glass transition temperature (Tg) of 72.1° ° C., a softening temperature of 153.6° C., and a weight average molecular weight (Mw) of 18,700.

Synthesis Example 15

Synthesis of Crystalline Polyester B1

A 5-liter four-neck flask equipped with a nitrogen inlet pipe, a dewatering pipe, a stirrer, and a thermocouple is charged with 1,6-hexanediol (serving as a diol) and sebacic acid (serving as a dicarboxylic acid) in amounts such that the molar ratio of OH groups to COOH groups becomes 1.10. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, a crystalline polyester B1 is prepared.

The crystalline polyester B has an acid value (AV) of 27.5 mgKOH/g, a melting point (Tm) of 64.0° C., and a weight average molecular weight (Mw) of 15,000.

Synthesis Example 16

Synthesis of Crystalline Polyester B2

The procedure in Synthesis Example 15 is repeated except that the amounts of the monomers are determined such that the molar ratio of OH groups to COOH groups becomes 1.03. Thus, a crystalline polyester B2 is prepared.

The crystalline polyester B2 has an acid value (AV) of 17.4 mgKOH/g, a melting point (Tm) of 66.2° C., and a weight average molecular weight (Mw) of 25,000.

Synthesis Example 17

Synthesis of Crystalline Polyester B3

A 5-liter four-neck flask equipped with a nitrogen inlet pipe, a dewatering pipe, a stirrer, and a thermocouple is charged with ethylene glycol (serving as a diol) and dodecanedioic acid (serving as a dicarboxylic acid) in amounts such that the molar ratio of OH groups to COOH groups becomes 1.03. After substituting the air in the flask with nitrogen gas, 300 ppm (based on the monomers) of titanium tetraisopropoxide are added to the flask. The mixture is heated to 200° C. over a period of 4 hours, further heated to 230° C. over a period of 2 hours, under nitrogen gas flow, until no efflux is observed. The reaction is further continued for 4 hours under reduced pressures of from 10 to 30 mmHg. Thus, a crystalline polyester B3 is prepared.

The crystalline polyester B3 has a melting point (Tm) of 84.5° C. and a weight average molecular weight (Mw) of 18,000.

Synthesis Example 18

Synthesis of Crystalline Polyester B4

A 2-liter four-neck flask equipped with a nitrogen inlet pipe, a dewatering pipe, a stirrer, and a thermocouple is charged with 300 g of the amorphous polyester A9 prepared in Synthesis Example 9 and 1,000 g of ethyl acetate. The mixture is stirred at 50° C. under nitrogen gas flow until it becomes uniform. An appropriate amount of 4,4'-diphenylmethane diisocyanate is added such that the molar ratio of NCO groups to OH groups in both the amorphous and crystalline resins becomes 0.6. After homogenizing the mixture, 200 ppm (based on solid contents) of tin 2-ethylhexanoate are added, and the mixture is heated to 75° C. After subjecting the mixture to a reaction for 1 hour, 700 g of a pulverized product of the crystalline polyester B1 prepared in Synthesis Example 15 are added, and the reaction is further continued for 5 hours. Thus, a crystalline polyester B4 is prepared.

The crystalline polyester B4 has a melting point (Tm) of 62.0° C. and a weight average molecular weight (Mw) of 28,000.

Synthesis Example 19

Synthesis of Crystalline Polyester B5

A 2-liter four-neck flask equipped with a nitrogen inlet pipe, a dewatering pipe, a stirrer, and a thermocouple is charged with 300 g of the amorphous polyester A9 prepared in Synthesis Example 9 and 1,000 g of ethyl acetate. The mixture is stirred at 50° C. under nitrogen gas flow until it becomes uniform. An appropriate amount of 4,4'-diphenylmethane diisocyanate is added such that the molar ratio of NCO groups to OH groups in both the amorphous and crystalline resins becomes 0.6. After homogenizing the mixture, 200 ppm (based on solid contents) of tin 2-ethylhexanoate are added, and the mixture is heated to 78° C. After subjecting the mixture to a reaction for 1 hour, 700 g of a pulverized product of the crystalline polyester B3 prepared in Synthesis Example 17 are added, and the reaction is further continued for 5 hours. Thus, a crystalline polyester B5 is prepared.

The crystalline polyester B5 has a melting point (Tm) of 84.5° C. and a weight average molecular weight (Mw) of 30,000.

Preparation of Black Colorant Dispersion Liquid

First, 17 parts of a carbon black (REGAL 400 from Cabot Corporation) and 3 parts of a colorant dispersant (AJISPER PB821 from Ajinomoto Fine-Techno Co., Inc.) are primarily dispersed in 80 parts of ethyl acetate using a mixer having stirrer blades. The resulting primary dispersion liquid is subjected to a dispersion treatment using a bead mill filled with zirconia beads having a diameter of 0.3 mm (LMZ from Ashizawa Finetech Ltd.) to more finely disperse the carbon black and completely remove aggregations having a size of 5 μm or more by application of a strong shearing force. Thus, a secondary dispersion liquid, i.e., a black colorant dispersion liquid, is prepared.

Preparation of Release Agent Dispersion Liquid

First, 18 parts of a carnauba release agent and 2 parts of a release agent dispersant are primarily dispersed in 80 parts of ethyl acetate using a mixer having stirrer blades. The resulting primary dispersion liquid is heated to 80° C. under stirring so that the carnauba release agent is dissolved. Subsequently, the liquid temperature is reduced to room temperature so that release agent particles are deposited with a maximum particle diameter being 3 μm or less. The release agent dispersant is a polyethylene release agent to which a styrene-butyl acrylate copolymer is grafted. The resulting primary dispersion liquid is subjected to a dispersion treatment using a bead mill filled with zirconia beads having a diameter of 0.3 mm (LMZ from Ashizawa Finetech Ltd.) to more finely disperse the release agent by application of a strong shearing force so that the maximum particle diameter of the release agent particles is adjusted to 1 μm or less.

Example 1

Preparation of Toner Composition Liquid

Dispersion liquids and/or solutions of a binder resin (i.e., a mixture of 90 parts of the amorphous polyester A1 and 10 parts of the crystalline polyester B1), a colorant, and a release agent are mixed using a mixer having stirrer blades at 60° C. for 10 minutes to obtain a toner composition liquid having a composition described in Table 1. Neither colorant nor release agent particles aggregate upon solvent dilution. As the solvent, ethyl acetate is used.

TABLE 1

| | Binder Resin (parts by weight) | Release Agent (parts by weight) | Release Agent Dispersant (parts by weight) | Colorant (Carbon Black) (parts by weight) | Charge Controlling Agent (FCA-2530N) (parts by weight) | Solid Content Concentration (% by weight) |
|---|---|---|---|---|---|---|
| Toner Composition Liquid | 100 | 10 | 0.5 | 5 | 1 | 10 |

Preparation of Toner

A toner is prepared from the above-obtained toner composition liquid using the toner manufacturing apparatus illustrated in FIG. 3 having the liquid droplet discharge device illustrated in FIG. 2 as follows. First, the toner composition liquid is formed into liquid droplets. The liquid droplets are dried, solidified, and collected by a cyclone collector. The collected particles are secondarily dried at 35° C. for 48 hours. Thus, a toner 1 is prepared.

Liquid Column Resonance Conditions

Resonant Mode: N=2

Length between both longitudinal ends of liquid column resonance liquid chamber: L=1.8 mm Height of frame on liquid-common-supply-path side end of liquid column resonance liquid chamber: h1=80 μm Height of communication opening of liquid column resonance liquid chamber: h2=40 μm Preparation Conditions for Mother Toner Particles Specific weight of dispersion liquid: $\rho$=1.1 g/cm$^3$ Shape of discharge hole: True circle Diameter of discharge hole: 7.5 μm Number of discharge holes: 4 per liquid column resonance liquid chamber Minimum distance between centers of adjacent discharge holes: 130 μm (all discharge holes are equally spaced)

Drying air temperature: 40° C.

Applied voltage: 10.0 V

Driving frequency: 395 kHz

Preparation of Carrier

The raw materials listed below are subjected to a dispersion treatment using a homomixer for 20 minutes, thereby preparing a resin layer coating liquid. The resin layer coating liquid is applied to the surfaces of 1,000 parts of magnetite particles having a volume average particle diameter of 35 μm by a fluidized bed coating device. Thus, a carrier is prepared.

| | |
|---|---|
| Silicone resin (Organo straight silicone) | 100 parts |
| γ-(2-Aminoethyl)aminopropyl trimethoxysilane | 5 parts |
| Carbon black | 10 parts |
| Toluene | 100 parts |

Preparation of Developer

A developer is prepared by mixing 5 parts of the toner 1 with 95 parts of the carrier.

Evaluations

The evaluations are performed in a manner described below. The results are shown in Table 2.

Lower-Limit Fixable Temperature

The developer is set in the tandem-type full-color image forming apparatus illustrated in FIG. 4. A solid image with a toner deposition amount of 0.85±0.10 mg/cm$^2$ and an image area of 3 cm×8 cm is formed on sheets of a transfer paper (printing paper <70> from Ricoh Japan Co., Ltd.) and fixed on each sheet at various fixing belt temperatures. The fixed image is subjected to a scratch drawing test with a drawing tester AD-401 (from Ueshima Seisakusho Co., Ltd.) equipped with a ruby needle (having a point radius of from 260 to 320 μm and a point angle of 60 degrees) at a load of 50 g. The image surface is then strongly rubbed with a fabric (HONECOTTO #440 from SAKATA INX ENG. CO., LTD) for 5 times. The temperature of the fixing belt at which almost no peeling-off of the image occurs is determined as the lower-limit fixable temperature.

The solid image is formed on the sheet 3.0 cm away from the leading edge in the paper feeding direction. The speed at which the sheet passes through the nip portion of the fixing device is 280 mm/s. The lower the lower-limit fixable temperature, the better the low-temperature fixability. Low-temperature fixability is evaluated based on the following criteria.

Evaluation Criteria

A: Lower-limit fixable temperature is not greater than 120° C.

B: Lower-limit fixable temperature is greater than 120° C. and not greater than 130° C.

C: Lower-limit fixable temperature is greater than 130° C.

Blocking Property (Penetration)

A 50-ml glass vial is filled with each toner and left in a constant-temperature chamber at 50° C. for 24 hours, followed by cooling to 24° C. The toner is then subjected to a penetration test based on JIS K-2235-1991 to measure a penetration (mm). The greater the penetration, the better the heat-resistant storage stability of the toner. When the penetration is less than 5 mm, there is a high possibility that the toner causes a problem in practical use.

Here, the penetration (mm) represents how deep the needle penetrates the toner in the vial.

Evaluation Criteria

A: Penetration is not less than 10 mm.

B: Penetration is not less than 5 mm and less than 10 mm.

C: Penetration is less than 5 mm.

Example 2

The procedure in Example 1 is repeated except that the crystalline polyester B1 is replaced with the crystalline polyester B2 and the weight ratio of the amorphous polyester A1 to the crystalline polyester B2 is set to 85/15. Thus, a toner 2 is prepared.

The toner is subjected to various measurements and evaluations in the same manner as Example 1. The results are shown in Table 2.

Example 3

The procedure in Example 1 is repeated except that the amorphous polyester A1 is replaced with the amorphous polyester A2. Thus, a toner 3 is prepared.

The toner is subjected to various measurements and evaluations in the same manner as Example 1. The results are shown in Table 2.

Example 4

The procedure in Example 1 is repeated except that the amorphous polyester A1 is replaced with the amorphous polyester A3. Thus, a toner 4 is prepared.

The toner is subjected to various measurements and evaluations in the same manner as Example 1. The results are shown in Table 2.

Example 5

The procedure in Example 1 is repeated except that the amorphous polyester A1 is replaced with the amorphous polyester A4. Thus, a toner 5 is prepared.

The toner is subjected to various measurements and evaluations in the same manner as Example 1. The results are shown in Table 2.

Example 6

The procedure in Example 1 is repeated except that the amorphous polyester A1 is replaced with the amorphous polyester A5. Thus, a toner 6 is prepared.

The toner is subjected to various measurements and evaluations in the same manner as Example 1. The results are shown in Table 2.

Example 7

The procedure in Example 1 is repeated except that the amorphous polyester A1 is replaced with the amorphous polyester A9. Thus, a toner 7 is prepared.

The toner is subjected to various measurements and evaluations in the same manner as Example 1. The results are shown in Table 2.

Example 8

The procedure in Example 1 is repeated except that the amorphous polyester A1 is replaced with the amorphous polyester A10. Thus, a toner 8 is prepared.

The toner is subjected to various measurements and evaluations in the same manner as Example 1. The results are shown in Table 2.

Example 9

The procedure in Example 1 is repeated except that the amorphous polyester A1 is replaced with the amorphous polyester A11. Thus, a toner 9 is prepared.

The toner is subjected to various measurements and evaluations in the same manner as Example 1. The results are shown in Table 2.

Example 10

The procedure in Example 1 is repeated except that the amorphous polyester A1 is replaced with the amorphous polyester A12. Thus, a toner 10 is prepared.

The toner is subjected to various measurements and evaluations in the same manner as Example 1. The results are shown in Table 2.

Example 11

The procedure in Example 8 is repeated except that the crystalline polyester B1 is replaced with the crystalline polyester B4 and the weight ratio of the amorphous polyester A10 to the crystalline polyester B4 is set to 86/14. Thus, a toner 11 is prepared.

The toner is subjected to various measurements and evaluations in the same manner as Example 1. The results are shown in Table 2.

Example 12

The procedure in Example 11 is repeated except that the crystalline polyester B4 is replaced with the crystalline polyester B5. Thus, a toner 12 is prepared.

The toner is subjected to various measurements and evaluations in the same manner as Example 1. The results are shown in Table 2.

Example 13

The procedure in Example 8 is repeated except that the crystalline polyester B1 is replaced with the crystalline polyester B3. Thus, a toner 13 is prepared.

The toner is subjected to various measurements and evaluations in the same manner as Example 1. The results are shown in Table 2.

Example 14

First, 100 parts of the binder resin used in Example 1, 10 parts of the release agent used in Example 1, 0.5 parts of the release agent dispersion liquid used in Example 1, 5 parts of the colorant used in Example 1, and 1 part of the charge controlling agent used in Example 1 are sufficiently mixed by a HENSCHEL MIXER. Next, the resulting mixture is melt-kneaded by a TWIN SCREW COMPOUNDER TEM-50 (from Toshiba Machine Co.). The kneaded product is rolled by application of pressure to have a thickness of from 2 to 5 mm, gently cooled on a conveyance belt, and coarsely pulverized by a feather mill.

The coarsely-pulverized product is pulverized by a jet mill pulverizer (IDS from Nippon Pneumatic Mfg. Co., Ltd.), and the pulverized product is classified by a rotor-type classifier (TURBOPLEX ULTRAFINE CLASSIFIER 100ATP). Thus, a toner 14 is obtained.

The toner is subjected to various measurements and evaluations in the same manner as Example 1. The results are shown in Table 2.

Example 15

The procedure in Example 1 is repeated except that the amorphous polyester A1 is replaced with the amorphous polyester A13. Thus, a toner 15 is prepared.

The toner is subjected to various measurements and evaluations in the same manner as Example 1. The results are shown in Table 2.

Example 16

The procedure in Example 1 is repeated except that the amorphous polyester A1 is replaced with the amorphous polyester A14. Thus, a toner 16 is prepared.

The toner is subjected to various measurements and evaluations in the same manner as Example 1. The results are shown in Table 2.

Comparative Example 1

The procedure in Example 1 is repeated except that the amorphous polyester A1 is replaced with the amorphous polyester A6. Thus, a toner 17 is prepared.

The toner is subjected to various measurements and evaluations in the same manner as Example 1. The results are shown in Table 2.

Comparative Example 2

The procedure in Example 2 is repeated except that the weight ratio of the amorphous polyester A1 to the crystalline polyester B2 is changed to 70/30. Thus, a toner 18 is prepared.

The toner is subjected to various measurements and evaluations in the same manner as Example 1. The results are shown in Table 2.

Comparative Example 3

The procedure in Example 1 is repeated except that the amorphous polyester A1 is replaced with the amorphous polyester A7. Thus, a toner 19 is prepared.

The toner is subjected to various measurements and evaluations in the same manner as Example 1. The results are shown in Table 2.

Comparative Example 4

The procedure in Example 1 is repeated except that the amorphous polyester A1 is replaced with the amorphous polyester A8. Thus, a toner 20 is prepared.

The toner is subjected to various measurements and evaluations in the same manner as Example 1. The results are shown in Table 2.

TABLE 2

| | | Amorphous Polyester A | | | | Crystalline Polyester B | | | Resin Ratio | Domain Size | | | | |
|---|---|---|---|---|---|---|---|---|---|---|---|---|---|---|
| | Toner | Type | Mw | Softening Temp. (° C.) | Tg (° C.) | Type | Mw | Tm (° C.) | A/B (by weight) | Toner Average Size (nm) | Deposit Average Size (μm) | TMA (%) | Lower-limit Fixable Temp. | Blocking Resistance |
| Example 1 | 1 | A1 | 22,000 | 148.3 | 62.5 | B1 | 15,000 | 64.0 | 90/10 | 80 | 1.5 | 1.8 | A | B |
| Example 2 | 2 | A1 | 22,000 | 148.3 | 62.5 | B2 | 25,000 | 66.2 | 85/15 | 80 | 2.5 | 1.6 | A | B |
| Example 3 | 3 | A2 | 18,000 | 134.5 | 60.2 | B1 | 15,000 | 64.0 | 90/10 | 70 | 1.6 | 2.4 | A | B |
| Example 4 | 4 | A3 | 17,900 | 139.3 | 58.6 | B1 | 15,000 | 64.0 | 90/10 | 80 | 2.0 | 2.9 | A | A |

TABLE 2-continued

| | | Amorphous Polyester A | | | | Crystalline Polyester B | | | | Domain Size | | | | |
|---|---|---|---|---|---|---|---|---|---|---|---|---|---|---|
| | Toner | Type | Mw | Softening Temp. (° C.) | Tg (° C.) | Type | Mw | Tm (° C.) | Resin Ratio A/B (by weight) | Toner Average Size (nm) | Deposit Average Size (μm) | TMA (%) | Lower-limit Fixable Temp. | Blocking Resistance |
| Example 5 | 5 | A4 | 20,000 | 190.0 | 90.0 | B1 | 15,000 | 64.0 | 90/10 | 70 | 2.8 | 1.3 | B | B |
| Example 6 | 6 | A5 | 23,700 | 143.4 | 58.2 | B1 | 15,000 | 64.0 | 90/10 | 60 | 0.5 | 2.1 | A | A |
| Example 7 | 7 | A9 | 12,800 | 135.8 | 71.0 | B1 | 15,000 | 64.0 | 90/10 | 100 | 2.5 | 2.8 | A | B |
| Example 8 | 8 | A10 | 19,700 | 152.1 | 69.2 | B1 | 15,000 | 64.0 | 90/10 | 80 | 2.1 | 1.6 | A | A |
| Example 9 | 9 | A11 | 9,000 | 140.4 | 77.9 | B1 | 15,000 | 64.0 | 90/10 | 90 | 2.4 | 2.3 | B | B |
| Example 10 | 10 | A12 | 22,700 | 166.9 | 77.3 | B1 | 15,000 | 64.0 | 90/10 | 70 | 1.7 | 1.4 | B | A |
| Example 11 | 11 | A10 | 19,700 | 152.1 | 69.2 | B4 | 28,000 | 62.0 | 86/14 | 65 | 1.2 | 2.3 | A | B |
| Example 12 | 12 | A10 | 19,700 | 152.1 | 69.2 | B5 | 30,000 | 84.5 | 86/14 | 60 | 1.3 | 1.8 | B | A |
| Example 13 | 13 | A10 | 19,700 | 152.1 | 69.2 | B3 | 18,000 | 84.5 | 90/10 | 70 | 1.9 | 1.3 | B | A |
| Example 14 | 14 | A1 | 22,000 | 148.3 | 62.5 | B1 | 15,000 | 64.0 | 90/10 | 90 | 1.5 | 1.7 | A | B |
| Example 15 | 15 | A13 | 19,200 | 151.2 | 69.6 | B1 | 15,000 | 64.0 | 90/10 | 100 | 4.6 | 2.3 | A | A |
| Example 16 | 16 | A14 | 18,700 | 153.6 | 72.1 | B1 | 15,000 | 64.0 | 90/10 | 120 | 6.2 | 2.7 | A | B |
| Comparative Example 1 | 17 | A6 | 16,700 | 123.2 | 48.4 | B1 | 15,000 | 64.0 | 90/10 | 80 | —* | 4.6 | A | C |
| Comparative Example 2 | 18 | A1 | 22,000 | 148.3 | 62.5 | B2 | 25,000 | 66.2 | 70/30 | 90 | 14 | 6.4 | A | C |
| Comparative Example 3 | 19 | A7 | 4,000 | 85.6 | 31.5 | B1 | 15,000 | 64.0 | 90/10 | Not formed | | 4.5 | A | C |
| Comparative Example 4 | 20 | A8 | 31,300 | 145.3 | 58.7 | B1 | 15,000 | 64.0 | 90/10 | 100 | 8.1 | 5.5 | B | C |

*In Comparative Example 1, the domain size in the deposition cannot be measured because domains in the form of a line exist together with spherical domains.

What is claimed is:

1. A toner, comprising:

a binder resin, including a crystalline polyester; and an amorphous polyester, wherein when the binder resin is extracted from the toner with tetrahydrofuran to obtain an extracted solution, and the extracted solution is heated to remove the tetrahydrofuran and obtain a deposit, the deposit contains spherical domains of the crystalline polyester having an average particle diameter of 7.0 μm or less.

2. The toner according to claim 1, wherein domains of the crystalline polyester in the toner have an average size of 150 nm or less.

3. The toner according to claim 1, wherein the deposit has a thermomechanical analysis compressive deformation ratio of 3.0% or less at 200 mN under a temperature of 40° C. and a relative humidity of 80%.

4. The toner according to claim 1, wherein the binder resin includes the crystalline polyester in an amount of from 1% to 20% by weight based on total weight of the binder resin.

5. The toner according to claim 1, wherein the amorphous polyester has a weight average molecular weight of from 10,000 to 35,000, a glass transition temperature of from 50° C. to 80° C., and a softening temperature of from 130° C. to 180° C.

6. The toner according to claim 1, wherein the crystalline polyester has a melting point of from 60° C. to 120° C. and a weight average molecular weight of from 10,000 to 35,000.

7. A developer, comprising:

the toner according to claim 1; and a carrier.

8. An image forming apparatus, comprising:

an electrostatic latent image bearer;

an image forming device to form an electrostatic latent image on the electrostatic latent image bearer; and a developing device to develop the electrostatic latent image into a visible image with the toner according to claim 1.

* * * * *